US012053857B2

(12) United States Patent
Herbert et al.

(10) Patent No.: US 12,053,857 B2
(45) Date of Patent: Aug. 6, 2024

(54) COATED ABRASIVES HAVING A PERFORMANCE ENHANCING COMPOSITION

(71) Applicants: SAINT-GOBAIN ABRASIVES, INC., Worcester, MA (US); SAINT-GOBAIN ABRASIFS, Conflans-Sainte-Honorine (FR)

(72) Inventors: Charles G. Herbert, Shrewsbury, MA (US); William C. Rice, Medway, MA (US); Jianna Wang, Grafton, MA (US); Robin Milshtein, Arlington, MA (US); Shih-Chieh Kung, Columbus, OH (US)

(73) Assignees: SAINT-GOBAIN ABRASIVES, INC., Worcester, WA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 248 days.

(21) Appl. No.: 17/187,203

(22) Filed: Feb. 26, 2021

(65) Prior Publication Data

US 2021/0178553 A1 Jun. 17, 2021

Related U.S. Application Data

(63) Continuation of application No. 15/850,896, filed on Dec. 21, 2017, now Pat. No. 11,027,397.

(Continued)

(51) Int. Cl.
*B24D 3/00* (2006.01)
*B24D 3/34* (2006.01)

(52) U.S. Cl.
CPC ..... *B24D 3/005* (2013.01); *B24D 3/342* (2013.01); *B24D 3/346* (2013.01)

(58) Field of Classification Search
CPC ..... B24D 3/005; B24D 3/342; B24D 3/346
See application file for complete search history.

(56) References Cited

U.S. PATENT DOCUMENTS 3,058,819 A ‡ 10/1962 Paulson ..... B24D 3/285 51/295
3,372,066 A ‡ 3/1968 Quaas ..... C23C 4/18 148/24

(Continued)

FOREIGN PATENT DOCUMENTS

CA 1293862 C 1/1992
CN 103232784 A 8/2013

(Continued)

OTHER PUBLICATIONS

Kaang et al., "Effects of Blend Composition and Mixing Method on Mechanical and Morphological Properties of Zinc Dimethacrylate-Reinforced Acrylonitrile-Butadiene Copolymer Nanocomposites," Polymer-Plastics Technology and Engineering, 2005, pp. 1517-1538, vol. 43, Issue 5.‡

(Continued)

*Primary Examiner* — James A Fiorito
*Assistant Examiner* — Ross J Christie
(74) *Attorney, Agent, or Firm* — Abel Schillinger, LLP; Arpan Ghosh

(57) ABSTRACT

The present disclosure relates generally to coated abrasive articles that include a tribological performance enhancing composition in a make coat, a size coat, a supersize coat, or combinations thereof, as well as methods of making coated abrasive articles. The present disclosure also relates to coated abrasive articles including a supersize coating comprising a sulfide scavenging composition and/or a cross-linked zinc acrylic binder, as well as methods for making and using such abrasive articles. The present disclosure also (Continued)

relates generally to abrasive articles that include aggregates having an anti-wear composition or grinding aid disposed on or within the aggregates.

52 Claims, 24 Drawing Sheets

Related U.S. Application Data

(60) Provisional application No. 62/440,596, filed on Dec. 30, 2016, provisional application No. 62/438,625, filed on Dec. 23, 2016.

(56) References Cited

U.S. PATENT DOCUMENTS 3,522,186 A ‡ 7/1970 Cushman ..... C11D 17/0013 510/397
3,950,047 A ‡ 4/1976 Capelli ..... F16C 33/102 384/298
4,049,396 A ‡ 9/1977 Hiles ..... B24D 3/344 51/295
4,226,602 A ‡ 10/1980 Fukuda ..... B24D 3/32 51/296
5,164,265 A ‡ 11/1992 Stubbs ..... B24D 3/004 428/421
5,184,434 A ‡ 2/1993 Hollinger ..... B24C 7/0007 451/36
5,273,558 A ‡ 12/1993 Nelson ..... C08G 18/5027 51/298
5,414,103 A ‡ 5/1995 Cracknell ..... C10M 137/04 558/90
5,417,726 A ‡ 5/1995 Stout ..... B24D 11/00 51/293
5,454,750 A ‡ 10/1995 Cosmano ..... B24D 3/34 451/526
5,458,962 A ‡ 10/1995 Birch ..... A47L 11/164 15/209.1
5,498,268 A ‡ 3/1996 Gagliardi ..... B24D 3/04 51/294
5,505,747 A ‡ 4/1996 Chesley ..... A44B 18/0049 156/245
5,551,962 A ‡ 9/1996 Ho ..... B24D 3/34 51/306
5,556,437 A ‡ 9/1996 Lee ..... B24D 3/28 51/298
5,565,011 A ‡ 10/1996 Follett ..... B24D 11/02 51/297
5,573,619 A ‡ 11/1996 Benedict ..... B24D 3/20 156/137
5,578,098 A ‡ 11/1996 Gagliardi ..... B24D 3/34 428/327
5,616,306 A ‡ 4/1997 Mazgarov ..... B01D 53/52 423/228
5,856,379 A ‡ 1/1999 Shiratsuchi ..... G03C 1/95 523/209
5,876,470 A ‡ 3/1999 Abrahamson ..... B24D 5/12 51/309
5,908,477 A ‡ 6/1999 Harmer ..... B24D 3/344 51/305
5,954,844 A ‡ 9/1999 Law ..... B24D 11/001 51/306
6,073,874 A ‡ 6/2000 Scheel ..... B60R 22/4628 242/374
6,176,945 B1 ‡ 1/2001 Bancroft ..... C23C 22/03 148/250
6,179,887 B1 ‡ 1/2001 Barber, Jr. ..... B24D 18/0009 51/298
6,251,149 B1 ‡ 6/2001 Meyer ..... B24D 3/344 51/298
6,354,929 B1 ‡ 3/2002 Adefris ..... C03C 19/00 451/527
6,444,132 B1 ‡ 9/2002 Orii ..... C09G 1/02 216/22
6,521,004 B1 ‡ 2/2003 Culler ..... B24D 3/14 23/313 R
6,620,214 B2 ‡ 9/2003 McArdle ..... B24D 3/14 23/313 R
6,645,263 B2 ‡ 11/2003 Keipert ..... B24D 3/32 51/296
6,743,267 B2 ‡ 6/2004 Jernakoff ..... C09G 1/02 106/3
6,755,728 B2 ‡ 6/2004 Sugiura ..... B24B 19/226 451/530
6,828,033 B1 ‡ 12/2004 Bancroft ..... C23C 22/03 428/469
6,992,125 B2 ‡ 1/2006 Keller ..... C09G 1/10 524/277
7,291,188 B2 ‡ 11/2007 Hirabayashi ..... B24B 37/24 51/298
7,329,175 B2 ‡ 2/2008 Woo ..... B24D 11/02 451/530
7,476,645 B2 ‡ 1/2009 Rosenbaum ..... C10M 107/02 508/110
7,498,109 B2 ‡ 3/2009 Wu ..... G03G 5/0514 399/159
7,520,800 B2 ‡ 4/2009 Duescher ..... B24D 11/001 451/527
7,687,123 B2 ‡ 3/2010 Broadus ..... B32B 27/34 428/34.9
8,016,125 B2 ‡ 9/2011 Lockledge ..... F01M 9/02 210/504
8,043,523 B2 ‡ 10/2011 Kaneko ..... C10M 171/008 252/68
8,080,072 B2 ‡ 12/2011 Woo ..... B24D 11/02 51/295
8,084,409 B2 ‡ 12/2011 Lucka ..... C11D 9/00 510/141
8,128,864 B2 ‡ 3/2012 Engler ..... C23C 26/00 266/280
8,465,838 B2 ‡ 6/2013 Wu ..... C08L 83/10 428/421
8,574,667 B2 ‡ 11/2013 John ..... E21B 41/00 427/189
8,747,544 B2 ‡ 6/2014 Reisacher ..... C09C 1/3036 106/482
8,986,717 B2 ‡ 3/2015 Franklin ..... A61K 8/65 424/401
9,017,150 B2 ‡ 4/2015 Keipert ..... C09K 3/1409 451/534
9,138,867 B2 ‡ 9/2015 Cai ..... C09K 3/1436
9,180,573 B2 ‡ 11/2015 Givot ..... C04B 35/1115
9,254,453 B2 ‡ 2/2016 McDaniel ..... C02F 1/52
9,359,575 B2 ‡ 6/2016 Malshe ..... C10M 129/74
9,416,291 B2 ‡ 8/2016 Wilbur ..... C09D 191/06
9,441,181 B2 ‡ 9/2016 Ivanov ..... C10M 141/04
2002/0061723 A1 ‡ 5/2002 Duescher ..... B24D 18/00 451/527
2002/0066233 A1 ‡ 6/2002 McArdle ..... C09K 3/1436 51/308
2002/0095871 A1 ‡ 7/2002 McArdle ..... B24D 3/14 51/298
2002/0142705 A1 ‡ 10/2002 Sugiura ..... B24D 3/344 451/41
2003/0045213 A1 ‡ 3/2003 Keipert ..... B24D 3/32 451/57
2003/0181144 A1 ‡ 9/2003 Mujumdar ..... B24B 7/241 451/41
2004/0134873 A1 ‡ 7/2004 Yao ..... H01L 21/3212 216/2
2005/0085167 A1 ‡ 4/2005 Swei ..... B24D 3/342 451/41
2005/0267247 A1 ‡ 12/2005 Steger ..... C08K 5/0025 524/492
2006/0026904 A1 ‡ 2/2006 Woo ..... B24D 3/28 51/293
2007/0134411 A1 ‡ 6/2007 Cont ..... B01J 13/02 427/213.34

(56) References Cited

U.S. PATENT DOCUMENTS

| | | | | |
|---|---|---|---|---|
| 2009/0042166 | A1‡ | 2/2009 | Craig | A61C 3/06 433/166 |
| 2009/0077900 | A1‡ | 3/2009 | Chuda | B24D 11/00 51/309 |
| 2010/0152067 | A1‡ | 6/2010 | McDonald | C09K 8/12 507/128 |
| 2010/0197557 | A1‡ | 8/2010 | Konishi | C11D 17/0013 510/397 |
| 2011/0155646 | A1‡ | 6/2011 | Karas | C10G 29/20 208/187 |
| 2011/0183142 | A1‡ | 7/2011 | Gebhardt | C09K 3/1436 428/402 |
| 2012/0252917 | A1‡ | 10/2012 | Kisin | C08L 23/0815 521/140 |
| 2012/0258903 | A1‡ | 10/2012 | Bjelopavlic | C11D 1/12 510/369 |
| 2013/0004393 | A1‡ | 1/2013 | Menendez | B01D 53/485 423/228 |
| 2013/0012416 | A1‡ | 1/2013 | Fujinami | C10M 169/02 508/154 |
| 2013/0014445 | A1* | 1/2013 | Wang | B24D 3/344 51/298 |
| 2013/0065490 | A1‡ | 3/2013 | Landin | B24D 13/14 451/28 |
| 2013/0305614 | A1‡ | 11/2013 | Gaeta | B24D 11/001 51/298 |
| 2014/0080393 | A1‡ | 3/2014 | Ludwig | D04H 1/413 451/532 |
| 2014/0087982 | A1‡ | 3/2014 | Calcavecchio | C10M 171/06 508/170 |
| 2014/0179206 | A1‡ | 6/2014 | Schoch | B24D 11/005 451/526 |
| 2015/0159112 | A1‡ | 6/2015 | Strandell | F16N 9/00 508/110 |
| 2015/0210842 | A1‡ | 7/2015 | Sakata | C08L 23/12 524/521 |
| 2015/0290771 | A1‡ | 10/2015 | Li | B24D 18/0018 51/295 |
| 2015/0290773 | A1‡ | 10/2015 | Banuelos | B24D 11/005 51/295 |
| 2016/0001423 | A1‡ | 1/2016 | Esteban | B24D 11/005 451/527 |
| 2016/0052227 | A1‡ | 2/2016 | Takihara | B32B 27/304 428/141 |
| 2016/0122507 | A1‡ | 5/2016 | Cox | C08L 95/00 106/268 |
| 2016/0151886 | A1‡ | 6/2016 | Sarangi | B24D 3/18 51/308 |
| 2016/0194540 | A1‡ | 7/2016 | Wang | B24D 3/002 51/309 |
| 2016/0221146 | A1‡ | 8/2016 | Lugg | C09G 1/02 |
| 2016/0229990 | A1‡ | 8/2016 | Du | C08G 59/245 |

FOREIGN PATENT DOCUMENTS

| | | | | |
|---|---|---|---|---|
| CN | 103232784 | A ‡ | 8/2013 | |
| CN | 103459561 | A | 12/2013 | |
| CN | 104131300 | A | 11/2014 | |
| CN | 104131300 | A ‡ | 11/2014 | |
| CN | 104440602 | A | 3/2015 | |
| CN | 104440602 | A ‡ | 3/2015 | |
| CN | 105885171 | A | 8/2016 | |
| CN | 105885171 | A ‡ | 8/2016 | |
| DE | 102008032882 | A1 ‡ | 1/2010 | C07F 9/2458 |
| DE | 102008032882 | A1 | 1/2010 | |
| EP | 1158033 | A1 ‡ | 11/2001 | C09G 1/16 |
| EP | 1158033 | A1 | 11/2001 | |
| EP | 0961670 | B1 | 7/2003 | |
| EP | 0961670 | B1 ‡ | 7/2003 | B24D 3/344 |
| GB | 819653 | A ‡ | 9/1959 | B24D 11/005 |
| GB | 819653 | A | 9/1959 | |
| GB | 847146 | A | 9/1960 | |
| GB | 847146 | A ‡ | 9/1960 | C10M 137/10 |
| GB | 894112 | A | 4/1962 | |
| GB | 894112 | A ‡ | 4/1962 | C09G 1/10 |
| GB | 1052218 | A | 12/1966 | |
| GB | 1052218 | A ‡ | 12/1966 | |
| GB | 1221739 | A | 2/1971 | |
| GB | 1221739 | A ‡ | 2/1971 | C07F 9/4006 |
| GB | 1428113 | A ‡ | 3/1976 | C08K 3/013 |
| GB | 1428113 | A | 3/1976 | |
| GB | 1468238 | A ‡ | 3/1977 | B24D 3/346 |
| GB | 1468238 | A | 3/1977 | |
| GB | 2013793 | A ‡ | 8/1979 | F16N 15/00 |
| GB | 2013793 | A | 8/1979 | |
| KR | 20050048853 | A | 5/2005 | |
| KR | 20050048853 | A ‡ | 5/2005 | |
| SU | 942949 | ‡ | 7/1982 | |
| WO | 95005921 | A1 | 3/1995 | |
| WO | WO-1995005921 | A1 ‡ | 3/1995 | |
| WO | 95023539 | A1 | 9/1995 | |
| WO | 95024991 | A1 | 9/1995 | |
| WO | WO-1995023539 | A1 ‡ | 9/1995 | |
| WO | WO-1995024991 | A1 ‡ | 9/1995 | |
| WO | 9906500 | A1 | 2/1999 | |
| WO | WO-WO-9906500 | A1 ‡ | 2/1999 | B24D 5/12 |
| WO | WO-0183166 | A1 * | 11/2001 | B24B 7/24 |
| WO | 2012128935 | A2 | 9/2012 | |
| WO | 2013016779 | A1 | 2/2013 | |
| WO | WO-2013016779 | A1 ‡ | 2/2013 | B24B 37/044 |
| WO | 2015088953 | A1 | 6/2015 | |
| WO | WO-2015088953 | A1 ‡ | 6/2015 | B24D 11/001 |
| WO | 2015100020 | A1 | 7/2015 | |
| WO | WO-2015100020 | A1 ‡ | 7/2015 | B24D 18/0054 |
| WO | 2016042524 | A1 | 3/2016 | |
| WO | WO-2016042524 | A1 ‡ | 3/2016 | C08K 3/04 |

OTHER PUBLICATIONS

Sudheer et al., "Mechanical and Abrasive Wear Behavior of Metal Sulphide Lubricant Filled Epoxy Composites," ISRN Polymer Science, 2013, 8 pgs, vol. 2013.‡

Henderson et al., "Ionically Cross-Linked Triblock Copolymer Hydrogels with High Strength," Macromolecules, 2010, pp. 6193-6201, vol. 43, No. 14 (abstract only).‡

Corinaldesi et al., "Reuse of ground waste glass as aggregate for mortars," Waste Management, 2005, pp. 197-201, vol. 25, Issue 2, Elsevier.‡

Hu et al., "The role of soot particles in the tribological behavior of engine lubricating oils," Wear, 2013, pp. 152-161, vol. 304, Elsevier.‡

"Michelman Launches Wax Dispersions," Coatings World, 2008.‡

Ivanov et al., "Nanodiamond-based oil lubricants on steel-steel and stainless steel—hard alloy high load contact: investigation of friction surfaces," Nanosystems: Physics, Chemistry Mathematics, 2014, pp. 160-166, vol. 5, No. 1.‡

Chu et al., "Preparation of Lightweight Aggregate Using Glass Abrasive Sludge and Effects of Pores on the Aggregate Properties," Journal of the Korean Ceramic Society, 2005, p. 37, vol. 42, No. 1, KR (abstract only).‡

International Search Report & Written Opinion for PCT/US2017/067966, mailed Apr. 6, 2018, 13 pages.‡

Ganc et al., "Aggregation Behavior of Common Motor Oil Additives," SAE, 1991, 14 pgs, Pennsylvania State University, US.‡

Carroll et al., "Using Waxes and Polymers to Improve Coatings Properties," European Polymers Paint Colour Journal, 1994, pp. 2-4, vol. 184, No. 4355 (abstract only).‡

Amosa et al., "Sulphide Scavengers in Oil and Gas Industry—A Review," NAFTA, 2010, pp. 85-92, vol. 61, No. 2.‡

Bec et al., "Relationship between mechanical properties and structures of zinc dithiophosphate anti-wear films," Proceedings of the Royal Society A, Dec. 8, 1999, pp. 4181-4203, vol. 455, GB (abstract only).‡

Ivanov et al., "Nanodiamond-based nanolubricants for motor oils," Current Opinion in Solid State and Materials Science, Feb. 2017, pp. 17-24, vol. 21, Issue 1, Elsevier (abstract only).‡

Ouyang et al., "Improving the aging resistance of asphalt by addition of Zinc dialkyldithiophosphate," Fuel, May 2006, pp. 1060-1066, vol. 85, Issues 7-8, Elsevier (abstract only).‡

(56) References Cited

OTHER PUBLICATIONS

Sudheer et al., "Mechanical and Abrasive Wear Behavior of Metal Sulphide Lubricant Filled Epoxy Composites," SRN Polymer Science, 2013, 8 pgs, vol. 2013.
"Michelman Launches Wax Dispersions," Coatings World, 2008, 1 page.

* cited by examiner
‡ imported from a related application

COATED ABRASIVES HAVING A PERFORMANCE ENHANCING COMPOSITION

CROSS-REFERENCE TO RELATED APPLICATIONS

This application is a continuation of and claims priority to U.S. patent application Ser. No. 15/850,896, entitled "COATED ABRASIVES HAVING A PERFORMANCE ENHANCING COMPOSITION," by Charles G. HERBERT et al., filed Dec. 21, 2017, which claims priority under 35 U.S.C. § 119(e) to U.S. Provisional Patent Application No. 62/438,625, entitled "COATED ABRASIVES HAVING A TRIBOLOGICAL PERFORMANCE ENHANCING COMPOSITION," by Charles G. HERBERT et al., filed Dec. 23, 2016, and claims priority under 35 U.S.C. § 119(e) to U.S. Provisional Patent Application No. 62/440,596, entitled "AGGREGATES AND ABRASIVE ARTICLES INFILTRATED WITH ANTI-WEAR AGENT FOR ABRASIVES PRODUCTS," by Jianna WANG et al., filed Dec. 30, 2016, all of which are assigned to the current assignees hereof and incorporated herein by reference in their entireties.

FIELD OF THE INVENTION

The present disclosure relates generally to coated abrasive articles that include a tribological performance enhancing composition in a make coat, a size coat, a supersize coat, or combinations thereof, as well as methods of making coated abrasive articles. The present disclosure also relates to coated abrasive articles including a supersize coating comprising a sulfide scavenging composition and/or a cross-linked zinc acrylic binder, as well as methods for making and using such abrasive articles. The present disclosure also relates generally to abrasive articles that include aggregates having an anti-wear composition or grinding aid disposed on or within the aggregates.

BACKGROUND

Abrasive articles, such as coated abrasives, are used in various industries to machine work pieces, such as by lapping, grinding, and polishing. Surface processing using abrasive articles spans a wide industrial scope from initial coarse material removal to high precision finishing and polishing of surfaces at a submicron level. Effective and efficient abrasion of metal surfaces, particularly iron-carbon alloys, such as carbon steel and stainless steel, and nickel-chromium alloys, such as Inconel, which are required for high performance oxidation resistant and corrosion resistant applications, pose numerous processing challenges.

Industries that produce or rely on such alloys are sensitive to factors that influence operational costs, including the speed at which a surface can be prepared, the cost of the materials used to prepare that surface, and the costs associated with the time expended to prepare a surface. Typically, industry seeks to achieve cost effective abrasive materials and processes that achieve high material removal rates. However, abrasives and abrasive processes that exhibit high removal rates often also tend to exhibit poor performance, if not impossibility, in achieving desired surface characteristics associated with high precision finishing and polishing of surfaces. Conversely, abrasives that produce such desirable surface characteristics often have low material removal rates, which can require more time and effort to remove a sufficient amount of surface material.

Therefore, there continues to be a demand for improved abrasive products and methods that can offer enhanced abrasive processing performance, efficiency, and improved surface quality.

BRIEF DESCRIPTION OF THE DRAWINGS

The present disclosure can be better understood, and its numerous features and advantages made apparent to those skilled in the art by referencing the accompanying drawings.

Figure 1:
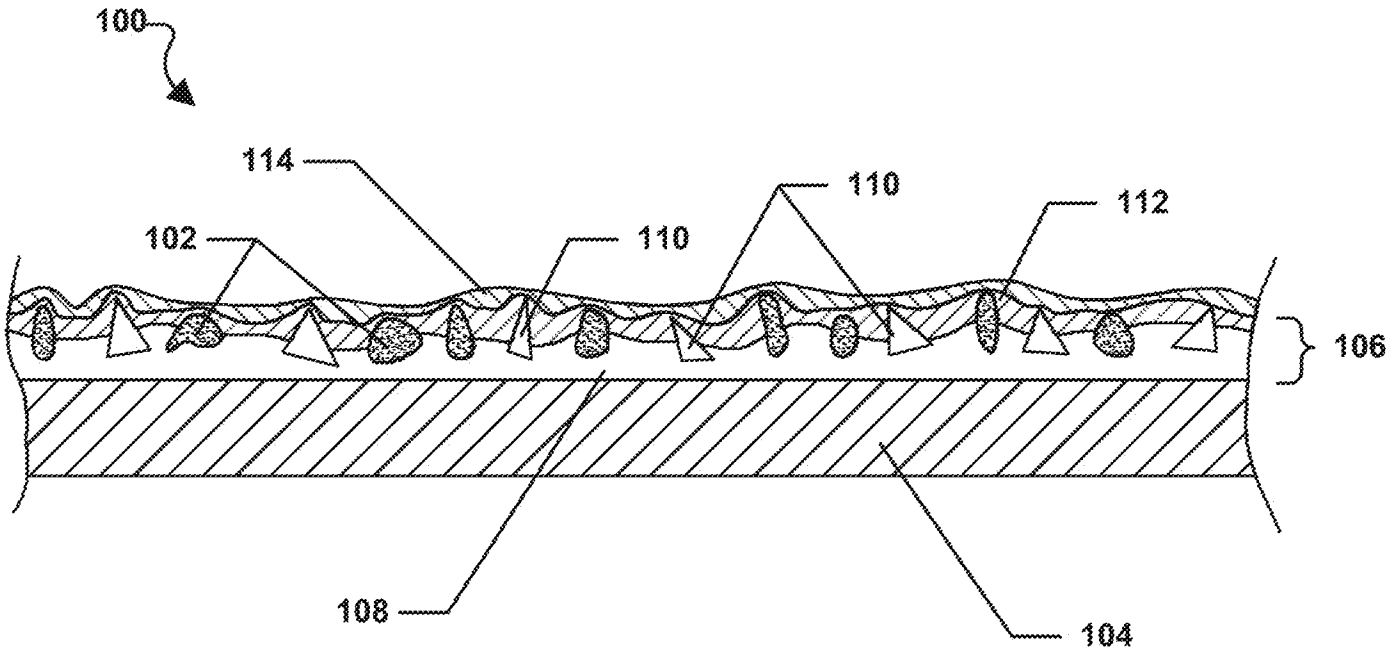
FIG. 1 is an illustration of a cross sectional view of an embodiment of a coated abrasive article that includes a tribological performance enhancing composition disposed in a supersize coat.

Skilled artisans appreciate that elements in the figures are illustrated for simplicity and clarity and have not necessarily been drawn to scale.

DETAILED DESCRIPTION

The following description, in combination with the figures, is provided to assist in understanding the teachings disclosed herein. The following discussion will focus on specific implementations and embodiments of the teachings. This discussion is provided to assist in describing the teachings and should not be interpreted as a limitation on the scope or applicability of the teachings.

The term "averaged," when referring to a value, is intended to mean an average, a geometric mean, or a median value. As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but can include other features not expressly listed or inherent to such process, method, article, or apparatus. As used herein, the phrase "consists essentially of" or "consisting essentially of" means that the subject that the phrase describes does not include any other components that substantially affect the property of the subject.

Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

Further, references to values stated in ranges include each and every value within that range. When the terms "about" or "approximately" precede a numerical value, such as when describing a numerical range, it is intended that the exact numerical value is also included. For example, a numerical range beginning at "about 25" is intended to also include a range that begins at exactly 25. Moreover, it will be appreciated that references to values stated as "at least about," "greater than," "less than," or "not greater than" can include a range of any minimum or maximum value noted therein.

As used herein, the phrase "average particle diameter" can be reference to an average, mean, or median particle diameter, also commonly referred to in the art as $D_{50}$.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and can be found in textbooks and other sources within the coated abrasive arts.

Coated Abrasive Article

Referring to FIG. 1, a coated abrasive article 100 is illustrated in cross-section. As depicted, the coated abrasive article 100 can include a substrate 104 (also called herein a backing material) on which an abrasive layer 106 can be disposed. The abrasive layer 106 can include abrasive particles 110 (also called herein abrasive grains) and aggregates 102 disposed on a polymeric make coat binder composition 108 and a polymeric size coat binder composition 112 disposed over the abrasive particles and the polymeric make coat binder composition. In an embodiment, an aggregate 102 can also be disposed on the polymeric make coat binder composition 108. The aggregate 102 can be an abrasive aggregate or nonabrasive aggregate. The aggregate 102 can comprise a tribological performance enhancing composition, a grinding aid composition, an anti-wear composition, or a combination thereof. A polymeric supersize coat binder composition 114 can be disposed on the abrasive layer 106. The polymeric supersize coat binder composition 114 can include a tribological performance enhancing composition disposed on or in (e.g., dispersed in) the polymeric supersize coat binder composition. According to yet another embodiment, the polymeric supersize coat binder composition 114 can comprise a sulfide scavenging composition. The sulfide scavenging composition can comprise a sulfide scavenging agent or a combination of sulfide scavenging agents.

Figure 2:
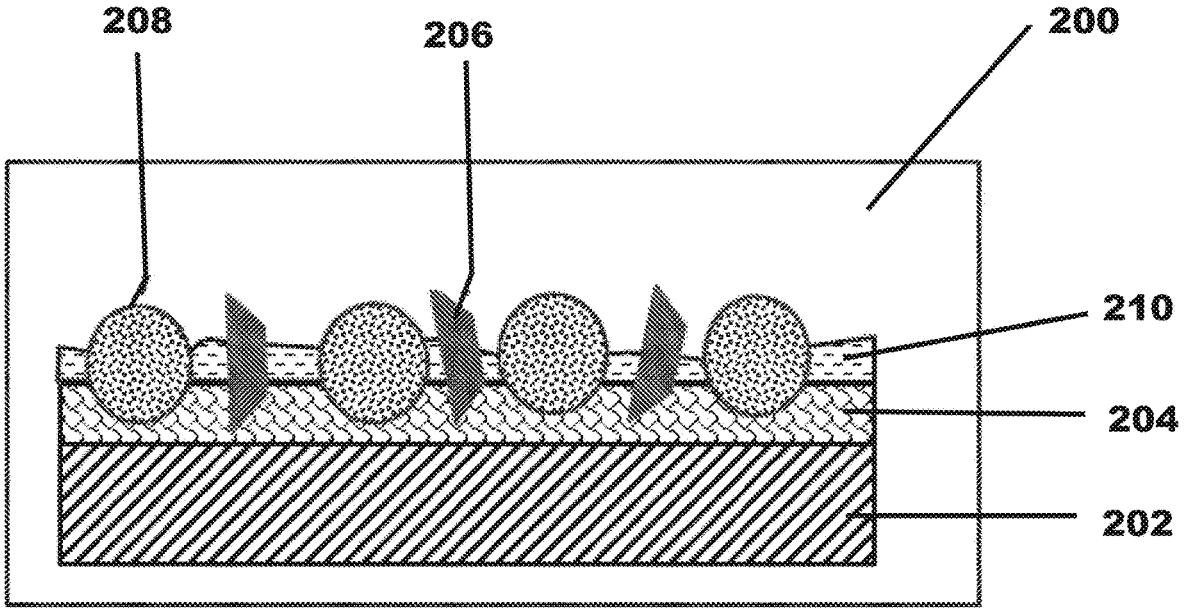
FIG. 2 is an illustration of a cross sectional view of an embodiment of a coated abrasive article that includes a grinding aid aggregate disposed on a make coat.

In FIG. 2, an embodiment of a coated abrasive article 200 is illustrated in cross-section. As depicted, the coated abrasive article 200 can include a polymeric make coat binder composition 204 (i.e., a make coat) disposed on a substrate 202 (backing material). Abrasive particles 206 (also called herein abrasive grains) can be disposed on the polymeric make coat binder composition. A tribological performance enhancing composition 208 in the form of an aggregate can also be disposed on the polymeric make coat binder composition. A polymeric size coat binder composition 210 can be disposed over the abrasive particles, the aggregates, and the polymeric make coat binder composition. Optionally, a polymeric supersize coat composition (not shown) can be disposed over the size coat.

Abrasive Article

In an embodiment the abrasive article can be a fixed abrasive article. Fixed abrasive articles can include coated abrasive articles, bonded abrasive articles, nonwoven abrasive articles, engineered abrasive articles, and combinations thereof. Abrasive articles can be in the form of sheets, discs, belts, tapes, wheels, thin wheels, flap wheels, flap discs, polishing films, and the like.

In certain embodiments, the abrasive article can be a bonded abrasive article comprising a plurality of abrasive particles and a bond matrix composition, wherein the abrasive particles are dispersed in the bond matrix composition.

In an alternative embodiment, the abrasive article can be a coated abrasive article comprising a backing material, a binder composition (also called herein a "make coat" composition, or a make coat) disposed on the backing, and composite abrasive aggregates disposed on or in the binder composition.

In an alternative embodiment, the abrasive article can be a nonwoven abrasive article comprising a substrate of nonwoven lofty fibers, a binder composition disposed on the substrate, and abrasive particles disposed on or in the binder composition.

Method of Making a Coated Abrasive Article

Figure 3:
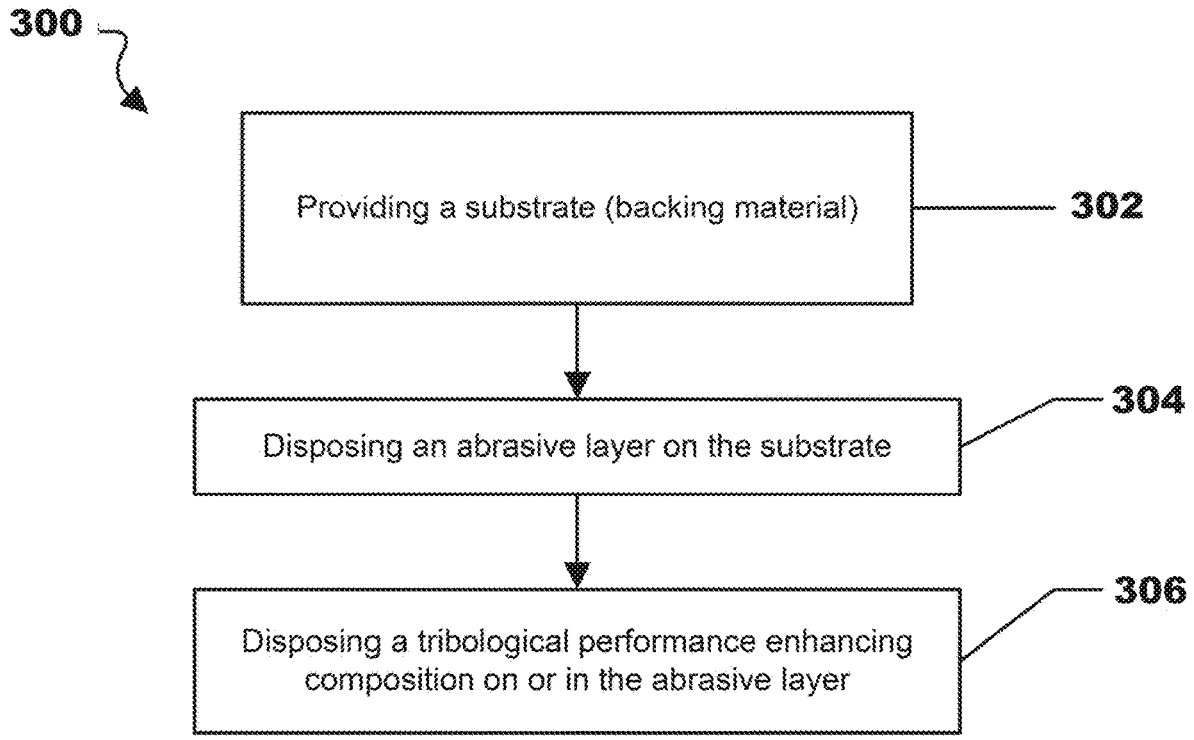
FIG. 3 is an illustration of a flow chart of an embodiment of a method of making a coated abrasive article that includes disposing a tribological performance enhancing composition on or in an abrasive layer.

FIG. 3 is an illustration of a flowchart of an embodiment of a method 300 of making a coated abrasive article having a tribological performance enhancing composition. At step 302, the method 300 includes providing a substrate (backing material). Step 304 can include disposing an abrasive layer on the substrate. Step 306 can include disposing a tribological performance enhancing composition on or in the abrasive layer.

Figure 4:
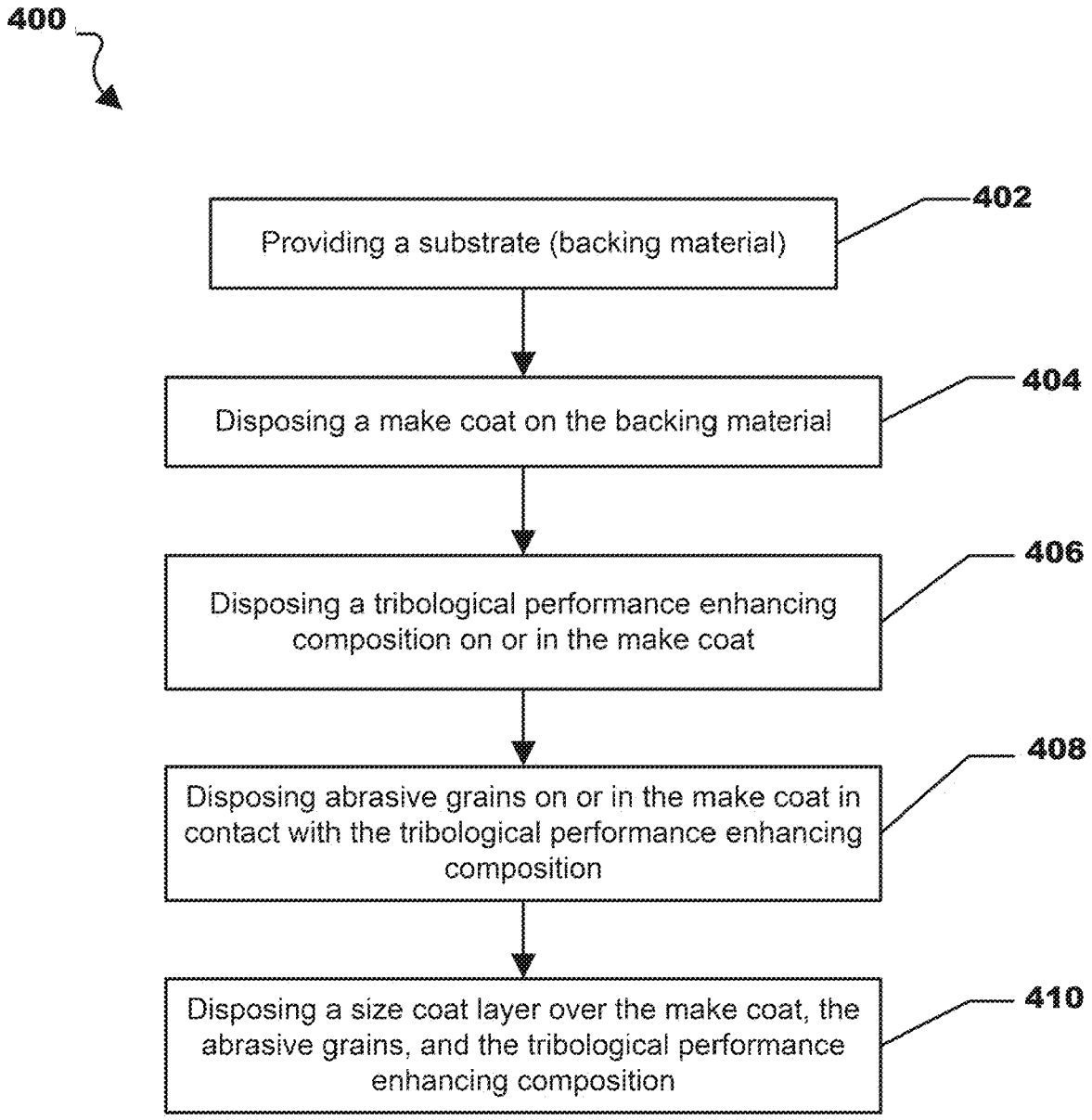
FIG. 4 is an illustration of a flow chart of an embodiment of a method of making a coated abrasive article that includes disposing a tribological performance enhancing composition disposed on or in a make coat.

FIG. 4 is an illustration of a flowchart of an embodiment of a method 400 of making a coated abrasive article containing a tribological performance enhancing composition in the form of an aggregate. Step 402 includes providing a substrate (backing material). Step 404 includes disposing a make coat on the backing material. Step 406 includes disposing a tribological performance enhancing composition on or in the make coat. In an embodiment, the tribological performance enhancing composition is in the form of an aggregate disposed on the make coat. Step 408 includes disposing abrasive grains on the make coat. The abrasive grains can be in contact with the tribological performance enhancing composition. Step 410 includes disposing a size coat over the abrasive grains and the tribological performance enhancing composition.

Figure 5:
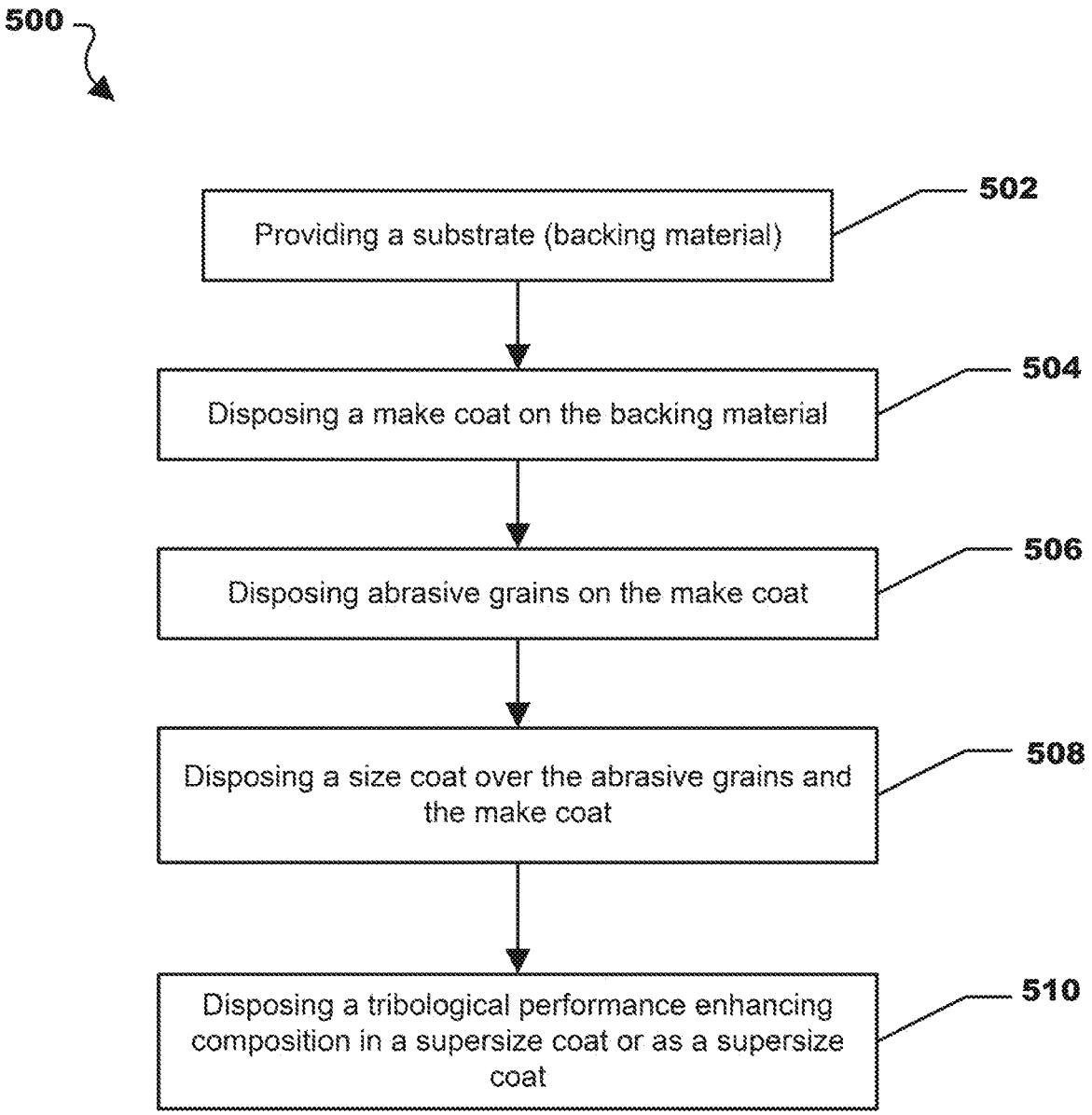
FIG. 5 is an illustration of a flow chart of an embodiment of a method of making a coated abrasive article that includes disposing a tribological performance enhancing composition disposed on or in a supersize coat.

FIG. 5 is an illustration of a flowchart of an embodiment of a method 500 of making a coated abrasive article containing a tribological performance enhancing composition disposed in a supersize coat. Step 502 includes providing a substrate (backing material). Step 504 includes disposing a make coat on the backing material. Step 506 includes disposing abrasive grains on the make coat. Step 508 includes disposing a size coat over the abrasive grains and the make coat. Step 510 includes disposing a tribological performance enhancing composition in a supersize coat or as a supersize coat.

A coated abrasive article including a sulfide scavenging composition can be made. In an embodiment, the method can comprise: providing a substrate (backing material); disposing an abrasive layer on the substrate; and disposing a sulfide scavenging composition on or in the abrasive layer.

A coated abrasive article including an anti-wear composition can be made. In an embodiment, an anti-wear composition can be included in the form of an aggregate. In an embodiment, the method can comprise: providing a substrate (backing material); disposing a make coat on the backing material; disposing an aggregate, which can be an abrasive aggregate, on or in the make coat, wherein an anti-wear composition is disposed in the aggregate; and disposing a size coat over the aggregates and the make coat. Optionally, a supersize coat can be applied over the size coat. The supersize coat can comprise a sulfide scavenging composition.

In an embodiment, a coated abrasive article including an anti-wear composition can be made. In an embodiment, the method can comprise: providing a substrate (backing material); disposing a make coat on the backing material; disposing an abrasive layer; and disposing a size coat over the abrasive layer and the make coat. Optionally, a supersize coat can be applied over the size coat. The supersize coat can comprise an anti-wear composition.

A coated abrasive article including a sulfide scavenging composition disposed in a supersize coat can be made. The method can comprise: providing a substrate (backing material); disposing a make coat on the backing material; disposing abrasive grains (or abrasive aggregates) on the make coat; disposing a size coat over the abrasive grains and the make coat; and disposing a sulfide scavenging composition in a supersize coat or as a supersize coat.

Figure 6:
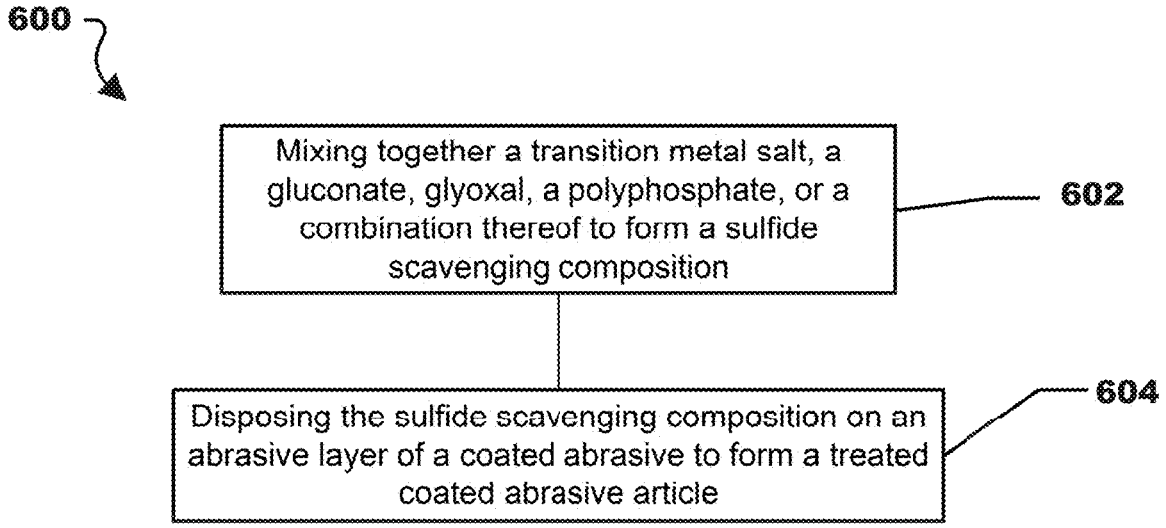
FIG. 6 is a process flow diagram of an embodiment of a method of making and using a sulfide scavenging composition.

FIG. 6 is a flow diagram of an embodiment of a method 600 of making a coated abrasive article including sulfide scavenging composition. In step 602, mixing together a transition metal salt, a gluconate, glyoxal, a polyphosphate, or a combination thereof occurs to form a sulfide scavenging composition. In step 604, disposing the sulfide scavenging composition on a coated abrasive article, such as on the size coat of a coated abrasive article, occurs to form a coated abrasive article including a sulfide scavenging composition.

Figure 7:
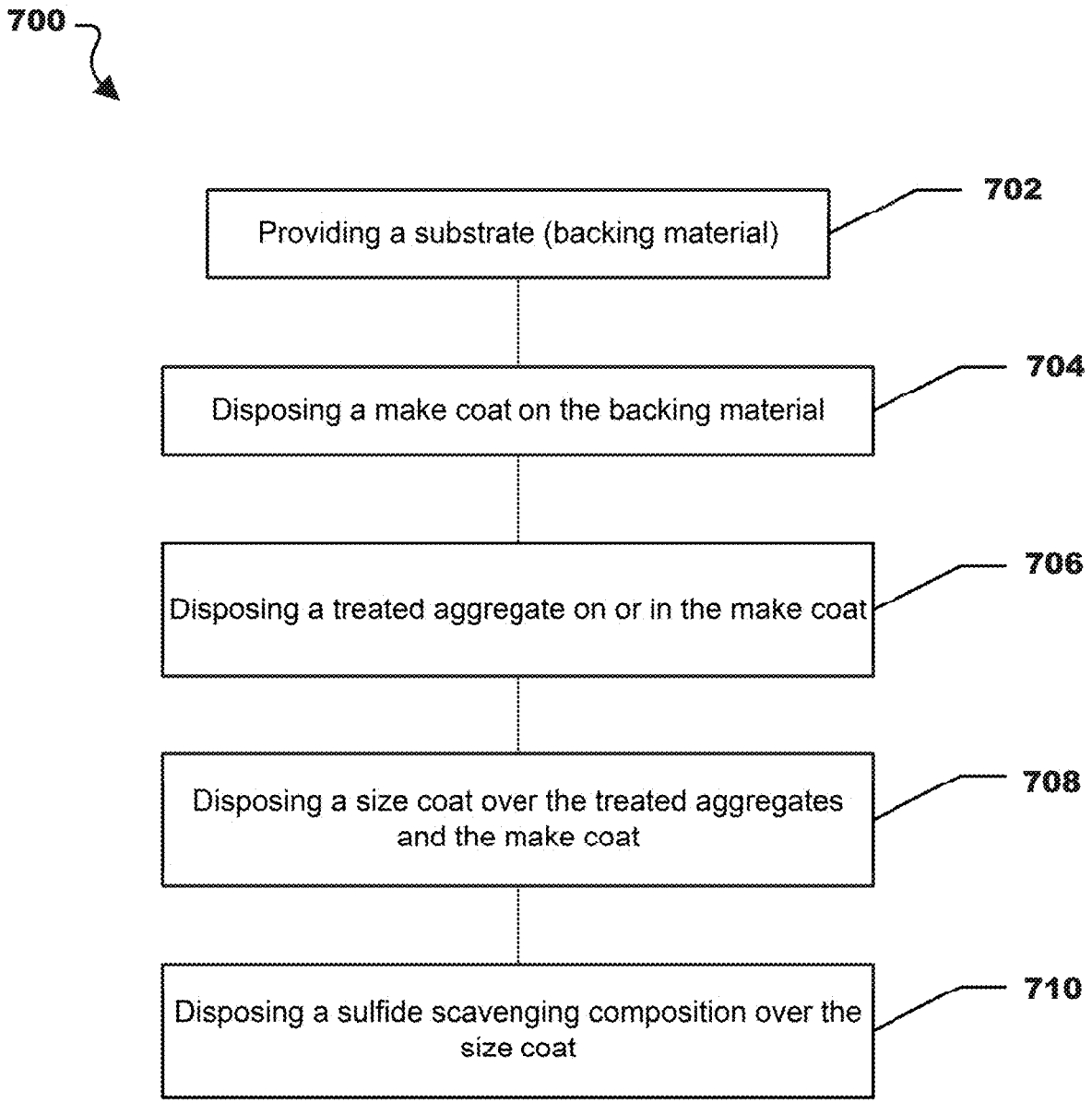
FIG. 7 is a process flow diagram of an embodiment of a method of making a coated abrasive article including aggregates having an anti-wear composition and a sulfide scavenging composition disposed over a size coat.

FIG. 7 is a flow diagram of an embodiment of a method 700 of making a coated abrasive article including a plurality of treated aggregates (i.e., abrasive aggregates comprising an anti-wear composition) and a sulfide scavenging composition in a supersize coat. In step 702, providing a substrate occurs. In step 704, disposing a make coat onto the substrate occurs. In step 706, disposing treated aggregates on or in the make coat occurs. In step 708, disposing a size coat over the treated aggregates and make coat occurs. In step 710, disposing a sulfide scavenging composition on the size coat occurs.

Tribological Performance Enhancing Composition

It has been surprisingly discovered that the presence of a tribological performance enhancing composition disposed on or in a supersize coat, on or in a size coat, on or in a make coat, or any combination thereof of a coated abrasive article provides unexpected and beneficial abrasive performance. In a particular embodiment, the tribological performance enhancing composition is disposed in a supersize polymeric binder. In another particular embodiment, the tribological performance enhancing composition is disposed in a size coat polymeric binder. In another particular embodiment, the tribological performance enhancing composition is disposed on or in a make coat polymeric binder. In an embodiment, the tribological performance enhancing composition can be essentially free or completely free of sulfur, or sulfur compounds.

Performance Enhancing Mixture

In an embodiment, a tribological performance enhancing composition can comprise a performance enhancing mixture of boric acid ($B(OH)_3$), a borate compound, or a combination thereof, and a zinc compound. In an embodiment, the performance enhancing mixture can further comprise a polyphosphate ester. In an embodiment, the performance enhancing mixture can further comprise a hypophosphite salt. In an embodiment, the performance enhancing mixture can further comprise cellulose or a cellulose composition. The performance enhancing mixture can include a polymeric binder composition (e.g., make coat binder, size coat binder, and/or supersize coat binder).

The amounts of the components of the performance enhancing mixture can vary. In an embodiment, the performance enhancing mixture can comprise:

40-70 wt % of a polymeric binder composition;

20-40 wt % of boric acid, a borate compound, or a combination thereof; and 10-30 wt % of a zinc compound, such as a zinc salt.

In an embodiment, the performance enhancing mixture can further comprise 20-30 wt % of a polyphosphate ester. In an embodiment, the performance enhancing mixture can further comprise 1-30 wt % hypophosphite salt. In an embodiment, the performance enhancing mixture can further comprises 0.1-5 wt % cellulose.

As stated previously, the performance enhancing compound can comprise boric acid, a borate compound, or a combination thereof. In an embodiment, a borate compound can comprise potassium tetraborate, potassium pentaborate, ammonium pentaborate, calcium borate, or any combination thereof.

As stated previously, the performance enhancing compound can comprise a zinc compound. In an embodiment the zinc compound can be a zinc salt. A zinc salt can comprise zinc borate, zinc phosphate, zinc stearate, zinc ammonium carbonate, or any combination thereof.

As stated previously, the performance enhancing compound can comprise a polyphosphate ester. In an embodiment, a polyphosphate ester can comprise Polyphosphate Ester ("PPE"), a polyether phosphate ester, an amine salt of polyether phosphate, or any combination thereof.

As stated previously, the performance enhancing compound can comprise a hypophosphite salt. In an embodiment, a hypophosphite salt can comprise sodium hypophosphite ($NaPO_2H_2$), potassium hypophosphite, or a combination thereof.

Fischer-Tropsch Hydrocarbon Product

In an embodiment, a tribological performance enhancing composition can comprise a Fischer-Tropsch hydrocarbon product. In an embodiment, Fischer-Tropsch hydrocarbon product can comprise a Fischer-Tropsch wax. In another embodiment, the Fischer-Tropsch hydrocarbon product can comprise a wax emulsion.

In an embodiment, the Fischer-Tropsch hydrocarbon product can comprise a Fischer-Tropsch synthetic crude oxygenate (i.e., an oxygenated hydrocarbon product resulting from a synthetic crude that is processed by the Fischer-Tropsch process). In an embodiment, the Fischer-Tropsch synthetic crude oxygenate can comprise an alcohol, an aldehyde, a carboxylic acid, a ketone, or any combination thereof having an aliphatic carbon chain of 4 to 40 carbon atoms, such as from 5 to 30 carbon atoms, such as from 8 to 25 carbon atoms.

Disposition of Tribological Performance Enhancing Composition in a Polymeric Layer or Combination of Layers The tribological performance enhancing composition can be present in one or more particular layers of the coated abrasive article. The tribological performance enhancing composition present in one layer can be same as or different than the tribological performance enhancing composition present in another layer. In an embodiment, the tribological performance enhancing composition is present in a supersize coat; a size coat, a make coat, or a combination thereof, such as both the supersize coat and the make coat. In a specific embodiment, a tribological performance enhancing composition is dispersed in the supersize coat. In another specific embodiment, a tribological performance enhancing composition is disposed on the make coat. In another specific embodiment, a tribological performance enhancing composition is dispersed in the supersize coat and disposed in the make coat. In another specific embodiment, a tribological performance enhancing composition is dispersed only in the supersize coat.

The amount of tribological performance enhancing composition in the supersize coat layer can vary. In an embodiment, the tribological performance enhancing composition can comprise the entire (i.e., 100 wt %) of the supersize coat. In another embodiment, the tribological performance enhancing composition can comprise only a portion of the supersize coat. In an embodiment, tribological performance enhancing composition in the supersize coat layer can be not less than 0.1 wt %, such as not less than 0.5 wt %, not less than 1 wt %, not less than 5 wt %, not less than 10 wt %, not less than 15 wt %, not less than 20 wt %, not less than 25 wt %, not less than 30 wt %, not less than 35 wt %, or not less than 40 wt % of the supersize coat. In another embodiment, the amount of tribological performance enhancing composition in the supersize coat can be not greater than 99 wt %, such as not greater than 95 wt %, not greater than 90 wt %, not greater than 85 wt %, not greater than 80 wt %, not greater than 75 wt %, not greater than 70 wt %, not greater than 65 wt %, or not greater than 60 wt %. The amount of tribological performance enhancing composition can be within a range comprising any pair of the previous upper and lower limits.

Anti-Wear Composition

In an embodiment, the anti-wear composition can comprise an anti-wear agent, or a combination of anti-wear agents, a fixative composition, a lubricant, or a combination thereof.

In an embodiment, an anti-wear agent can comprise an organophosphate, such as a phosphate ester, a thiophosphate ester, a dithiophosphate ester, or combinations thereof. In an embodiment, the anti-wear agent can include zinc. Suitable anti-wear agents that include zinc are zinc dithiophosphates (ZDP), zinc dialkyl dithio phosphates (ZDDP), tricresyl phosphates (TCP), or combinations thereof. The ZDDP can be monomeric ZDDP, dimeric ZDDP, tetrameric ZDDP (also called basic ZDDP), polymeric ZDDP, or combinations thereof. In another embodiment, the anti-wear agent does not include zinc. Suitable anti-wear agents that do not include zinc are "ashless" dithiophosphates, such as dialkyldithiophphoric acid, amino dialkydithiophosphate salts, aminodialklydithiophates, and combinations thereof.

In a particular embodiment, the amount of anti-wear agent in the anti-wear composition can vary. In an embodiment, the amount of anti-wear agent can be essentially completely (100 wt %, minus any naturally occurring contaminants) to completely (100 wt %) all of the anti-wear composition. In another embodiment, the amount of anti-wear agent can be a fractional amount of the anti-wear composition. In an embodiment, the amount of anti-wear agent can be not less than 0.01 wt % of the anti-wear composition, such as not less than 1.0 wt %, not less than 3.0 wt %, not less than 5.0 wt %, not less than 7.5 wt %, not less than 10 wt %, not less than 15 wt %, not less than 20 wt %, not less than 25 wt %, or not less than 30 wt % of the anti-wear composition. In an embodiment, the amount of anti-wear agent in the anti-wear composition can be not greater than 90 wt % of the anti-wear composition, such as not greater than 89 wt %, not greater than 87 wt %, not greater than 85 wt %, not greater than 80 wt %, not greater than 75 wt %, not greater than 70 wt %, not greater than 65 wt %, not greater than 60 wt %, not greater than 55 wt %, not greater than 50 wt %, not greater than 45 wt %, or not greater than 40 wt % of the anti-wear composition. The amount of anti-wear agent can be within a range comprising a pair of any of the previous upper and lower limits. In a particular embodiment, the amount of anti-wear agent in the anti-wear composition can be within a range of 0.01 wt % to 90 wt % of the anti-wear composition, such as from 0.1 wt % to 89 wt %, such as from 1.0 wt % to 87 wt %, such as from 1.5 wt % to 85 wt % of the anti-wear composition.

In an embodiment, the anti-wear composition can further comprise a fixative material. The fixative material can comprise a binder or glue material capable of fixing or adhering the anti-wear composition to the abrasive aggregate, such as by drying, curing, adsorption, or other suitable adhesion method. In an embodiment, the fixative composition can comprise an organic binder, an inorganic binder, or a combination thereof. In an embodiment, the fixative composition can comprise a glue, such as a natural glue, synthetic glue, or a combination thereof. In a particular embodiment, the fixative composition can comprise polyvinyl acetate (e.g., Fevicol). In another embodiment, the fixative composition can comprise a polymeric resin or combination of polymeric resins. In a particular embodiment, the fixative composition can comprise a phenolic resin. In another embodiment, the fixative composition can comprise a clay, such as a natural clay, modified natural clay, including functionalized clays (e.g., Cloisite clay), synthetic clays, or combinations thereof. In another embodiment, the fixative composition can comprise a hydrous mineral, such as a calcium aluminium sulfate mineral (e.g., Ettringite—$Ca_6Al_2(SO_4)_3(OH)_{12}\cdot 26H_2O$).

In a particular embodiment, the amount of fixative composition in the anti-wear composition can vary. In an embodiment, the amount of fixative composition can be not less than 1.0 weight percent of the composition, such as not less than 5 weight percent, not less than 10 weight percent, not less than 15 weight percent, not less than 20 weight percent, not less than 30 weight percent, not less than 40 weight percent, not less than 50 weight percent, not less than 55 weight percent, not less than 60 weight percent, or not less than 65 weight percent of the anti-wear composition. In an embodiment, the amount of fixative composition in the anti-wear composition can be not greater than 90 weight percent of the composition, such as not greater than 85 weight percent, not greater than 80 weight percent, not greater than 75 weight percent, not greater than 70 weight percent, not greater than 65 weight percent, not greater than 60 weight percent, not greater than 55 weight percent, not greater than 50 weight percent, not greater than 45 weight percent, not greater than 40 weight percent, not greater than 35 weight percent, or not greater than 30% of the anti-wear composition. The amount of fixative composition can be within a range comprising a pair of any of the previous upper and lower limits. In a particular embodiment, the amount of fixative composition in the anti-wear composition can be within a range of 1.0 weight percent to 95 weight percent of the anti-wear composition, such as from 10 weight percent to 90 weight percent of the anti-wear composition.

In an embodiment, the anti-wear composition can further comprise a lubricant composition. In an embodiment, the lubricant can comprise a hydrocarbon material or mixtures of hydrocarbon materials, such as alkanes, cycloalkanes, or combinations thereof. In an embodiment, the hydrocarbon material can have at least 5 carbon atoms, such as at least 8 carbon atoms, such as at least 10 carbon atoms, such as at least 12 carbon atoms. In another embodiment, the hydrocarbon material can have not greater than 100 carbon atoms, such as not greater than 90 carbon atoms, not grant greater than 80 carbon atoms, not greater than 70 carbon atoms, not greater than 60 carbon atoms, or not greater than 50 carbon atoms. In a particular embodiment, the hydrocarbon material can have at least 5 carbon atoms to 100 carbon atoms, such as from at least 8 carbon atoms to 70 carbon atoms, such as at least 10 carbon atoms to 60 carbon atoms, such as from 12 carbon atoms to 50 carbon atoms.

In an embodiment, the lubricant can comprise a paraffin material, such as a liquid paraffin, a solid paraffin, or combinations thereof. In a particular embodiment, the paraffin material can comprise what is commonly known as liquid paraffin (also called, "white oil", "mineral oil"), a paraffin wax, or combinations thereof.

In an embodiment, the lubricant can comprise an oil, a wax, a grease, or combinations thereof. In a particular embodiment, the oil can be a mineral oil, a vegetable oil, an animal oil, a synthetic oil, or combinations thereof. In a particular embodiment, the oil can comprise a mineral oil, such as any of various light mixtures of higher alkanes from a mineral source, particularly a distillate of petroleum. In a particular embodiment, the oil can be what is commonly known as "motor oil" or "engine oil". Suitable motor oils and engine oils can be those oils rated for viscosity by the Society for Automotive Engineers ("SAE") designated as SAE 5W, 10W, 15W, 20W, 25W, 20, 30, 40, 50, or 60 weight oil, or combinations thereof. In a particular embodiment, the lubricant is an SAE 20w-40 motor oil.

In an embodiment, a vegetable oil is an oil that is extracted from a plant, usually from the fruits or seeds. Suitable vegetable oils can include canola oil, coconut oil, corn oil, cottonseed oil, olive oil, palm oil, peanut oil, rapeseed oil, safflower oil, sesame oil, soybean oil, sunflower oil, and combination thereof.

In a particular embodiment, the amount of lubricant in the anti-wear composition can vary. In an embodiment, the amount of lubricant can be not less than 1 weight percent of the anti-wear composition, such as not less than 3 weight percent, not less than 5 weight percent, not less than 10 weight percent, not less than 20 weight percent, not less than 30 weight percent, not less than 40 weight percent, not less than 50 weight percent, not less than 60 weight percent, not less than 70 weight percent, or not less than 80 weight percent of the anti-wear composition. In an embodiment, the amount of lubricant in the anti-wear composition can be not greater than 90 weight percent of the composition, such as not greater than 85 weight percent, not greater than 80 weight percent, not greater than 70 weight percent, not greater than 60 weight percent, not greater than 50 weight percent, not greater than 45 weight percent, not greater than 40 weight percent, not greater than 30 weight percent, not greater than 20 weight percent, or not greater than 10% of the anti-wear composition. The amount of lubricant can be within a range comprising a pair of any of the previous upper and lower limits. In a particular embodiment, the amount of lubricant in the anti-wear composition can be within a range of 1 weight percent to 99 weight percent of the anti-wear composition, such as from 5 weight percent to 95 weight percent, such as from 10 weight percent to 90 weight percent, such as from 20 weight percent to 80 weight percent, such as from 40 weight percent to 70 weight percent of the anti-wear composition.

In a particular embodiment, the amounts of component materials of the anti-wear composition can be in particular ratios to each other that are beneficial. In an embodiment the ratio of lubricant to fixative ranges from 3:1 to 1:20, such as 1:1 to 1:3.

In a particular embodiment, the anti-wear composition is present in the supersize layer.

Sulfide Scavenging Composition

The presence of a sulfide scavenging composition disposed on or in a supersize coat, on or in a size coat, on or in a make coat, or any combination thereof of a coated abrasive article provides beneficial abrasive performance as well as solves the problem of unwanted sulfide emissions that can occur during an abrasive process when an abrasive article includes various sulfur compounds in its additives and/or component layers. In a particular embodiment, the sulfide scavenging composition is disposed in a supersize polymeric binder. In another embodiment, the sulfide scavenging composition is disposed as a supersize coating, but not necessarily polymeric. In another particular embodiment, the sulfide scavenging composition is disposed in a size coat polymeric binder. In another particular embodiment, the sulfide scavenging composition is disposed on or in a make coat polymeric binder.

In an embodiment, a sulfide scavenging composition can comprise one or more sulfide scavenging agents. In an embodiment, a sulfide scavenging composition can comprise a transition metal salt, a gluconate, glyoxal, a polyphosphate, or a combination thereof. In an e embodiment, the transition metal salt can be a titanium salt, a manganese salt, an iron salt, a nickel salt, a copper salt, a zinc salt, or a combination thereof. In an embodiment, the transition metal salt can comprise a transition metal oxide, a transition metal carbonate, a transition metal borate, a transition metal phosphate, or a combination thereof. In an embodiment, the transition metal salt can comprise a zinc compound. In an embodiment, the zinc compound can comprise a zinc oxide, zinc carbonate, zinc stearate, zinc borate, zinc phosphate, zinc naphthenate, or a combination thereof. In an embodiment, the transition metal salt can comprise iron oxide, iron carbonate, iron stearate, iron phosphate, iron naphthenate, or a combination thereof. In an embodiment, the gluconate can comprise ferrous gluconate. In an embodiment, the sulfide scavenging composition can further comprise a polyphosphate, a polyphosphate ester, or a combination thereof.

The amounts of the components of the sulfide scavenging composition can vary.

Aggregates

In an embodiment, a plurality of aggregates is disposed on or in the make coat. In yet another embodiment, a plurality of aggregates is disposed on or in the size coat. The aggregates can be abrasive aggregates, nonabrasive aggregates, or a combination thereof. The aggregates can comprise a tribological performance enhancing composition, a grinding aid composition, an anti-wear composition, or a combination thereof. In an embodiment, the plurality of aggregates can be in the form of a grinding aid aggregate as described herein. In yet another embodiment, the plurality of aggregates can be in the form of an abrasive aggregate as described herein.

Grinding Aid Aggregates

In an embodiment, the tribological performance enhancing composition can comprise a grinding aid aggregate comprising a polymeric binder and a grinding aid, or mixture of grinding aids.

The amounts of the components of the grinding aid aggregate can vary. In an embodiment, the grinding aid ggregate can comprise:

60-99 wt % of grinding aid; and 1-40 wt % of polymeric binder.

In an embodiment, the grinding aid can comprise potassium fluoroborate, cryolite, or a combination thereof. In an embodiment, the polymeric binder composition can comprise a phenolic polymeric composition, such as a phenolic resole composition; a urea formaldehyde composition; a urethane composition; an epoxy composition; a polyimide composition; a polyamide composition; a polyester composition; an acrylate composition; a protein based composition; a starch based composition, or any combination thereof.

Abrasive Aggregates

Figure 8:
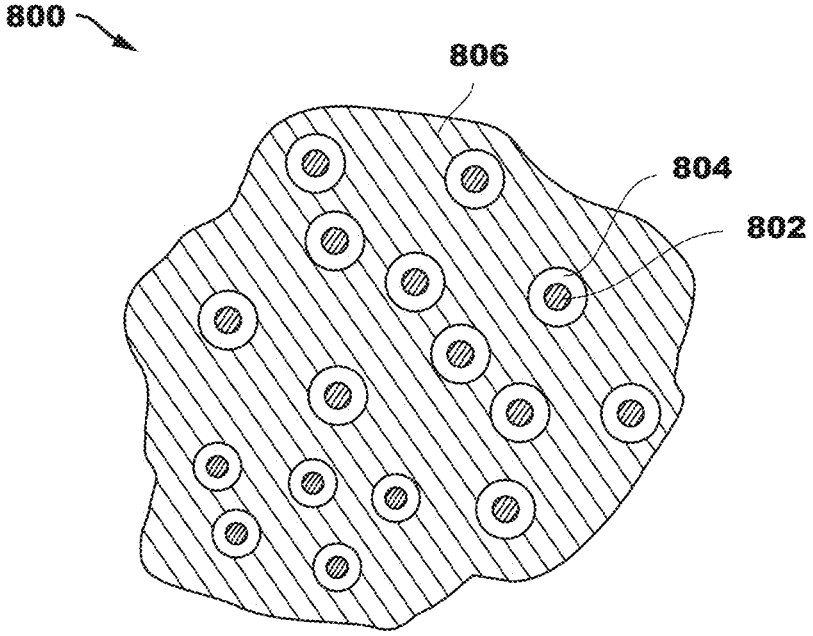
FIG. 8 is a cross-section illustration of an embodiment of an aggregate that includes an anti-wear composition.

FIG. 8 is an illustration of an abrasive aggregate 800 embodiment. A plurality of particles 802, which can be abrasive particles, can be bound together by an aggregate binder composition 806. An anti-wear composition 804 can be disposed in contact with the particles 802 and the aggregate binder composition 806. In an embodiment, the anti-wear coating is disposed on the surface of the particles 802 and can be disposed between the particle and the aggregate binder composition 806. In an embodiment, the particle 802 can be coated (e.g., enveloped) with the anti-wear composition 804. In an embodiment, the aggregate binder composition 806 can comprise a continuous phase. In an embodiment, the aggregate binder composition 806 can be an organic polymeric composition.

Figure 9:
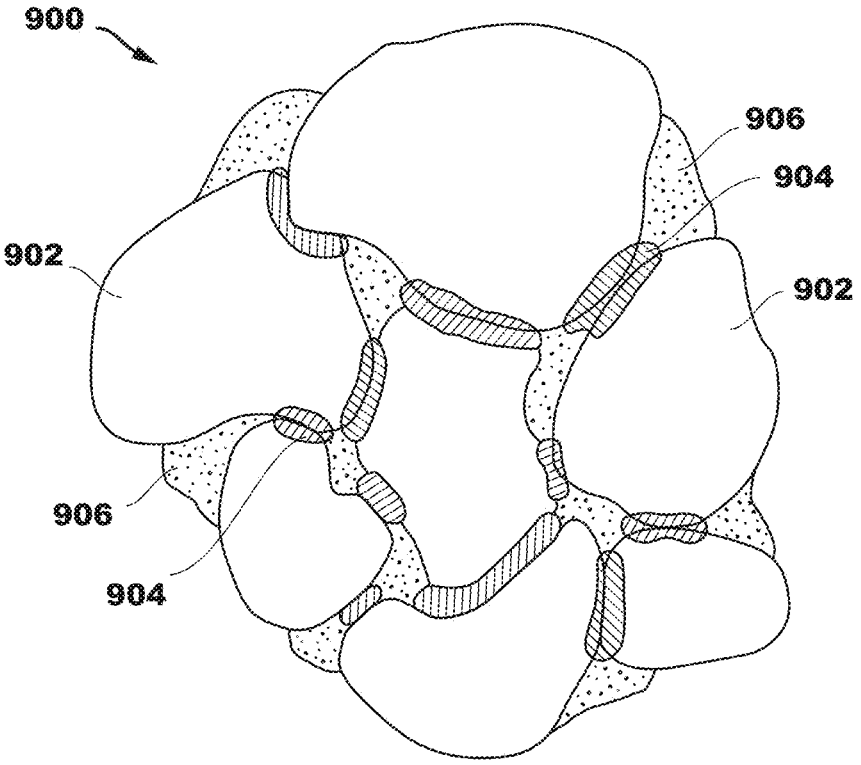
FIG. 9 is a cross-section illustration of another embodiment of an aggregate that includes an anti-wear composition.

FIG. 9 is an illustration of an abrasive aggregate 900 embodiment. A plurality of particles 902, which can be abrasive particles, can be bound together by an aggregate binder composition 904. In an embodiment, the aggregate binder composition 904 can comprise a bond interface between the particles 902 that joins the particles together. In an embodiment, the aggregate binder composition can comprise a discontinuous phase. In an embodiment, the bond interface can comprise bond posts located at points of contact between the particles 902. In an embodiment, the aggregate binder composition can comprise a vitreous binder composition. An anti-wear composition 906 can be disposed between the particles 902 and/or disposed on the surface of the particles 902.

Figure 10:
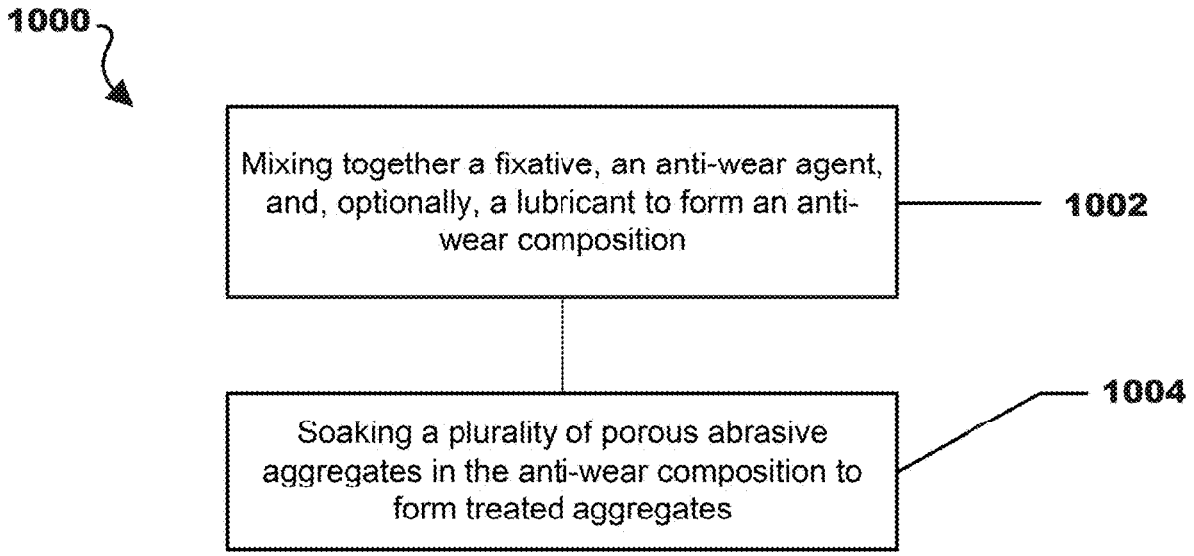
FIG. 10 is a process flow diagram of an embodiment of a method of making an aggregate that includes an anti-wear composition.

FIG. 10 is a flow diagram of an embodiment of a method 1000 of making an abrasive aggregate including an anti-wear composition. In step 1002, mixing together a fixative and an anti-wear agent occurs to form an anti-wear composition. Optionally, a lubricant can also be mixed together with the fixative and anti-wear agent during step 1002. In step 1004, soaking a porous abrasive aggregate occurs to form a treated abrasive aggregate that includes the anti-wear composition.

In an embodiment, each abrasive aggregate comprises an aggregate binder composition and a plurality of abrasive grit particles dispersed in the binder composition. In an embodiment, the abrasive aggregate can further comprise an anti-wear composition. The aggregate binder composition can comprise a ceramic binder, a vitreous binder, a polymeric resin binder, or a combination thereof. In a specific embodiment, an aggregate binder composition can comprise a vitreous binder. In another specific embodiment, an aggregate binder composition can comprise a polymeric resin binder. The aggregate binder composition 806 as shown in FIG. 8 can be a polymeric resin binder. The aggregate binder composition 904 as shown in FIG. 9 can be a vitreous binder.

The amount of the aggregate binder composition in an abrasive aggregate can vary. In an embodiment, the aggregate binder comprises at least 0.5 wt % of the abrasive aggregate, such as at least 1 wt %, such as at least 2 wt %, at least 3 wt %, at least 4 wt %, at least 5 wt %, at least 7 wt %, at least 10 wt %, or at least 15 wt % of the abrasive aggregate. In another embodiment, the aggregate binder comprises not greater than 60 wt % of the abrasive aggregate, such as not greater than 55 wt %, not greater than 50 wt %, or not greater than 45 wt % of the abrasive aggregate. The amount of the aggregate binder composition can be within a range of any minimum or maximum value noted above. In a specific embodiment, the amount of the aggregate binder composition comprises from at least 0.5 wt % to not greater than 50 wt % of the abrasive aggregate.

The amount of the abrasive grit particles in an abrasive aggregate can vary. In an embodiment, the abrasive grit particles can comprise at least 5 wt % of the abrasive aggregate, such as at least 10 wt % of the abrasive aggregate, such as at least 15 wt %, at least 20 wt %, or at least 25 wt % of the abrasive aggregate. In another embodiment, the abrasive grit particles comprises not greater than 80 wt % of the abrasive aggregate, such as not greater than 75 wt %, not greater than 70 wt %, not greater than 65 wt %, not greater than 60 wt %, or not greater than 55 wt % of the abrasive aggregate. The amount of the abrasive grit particles can be within a range of any minimum or maximum value noted above. In a specific embodiment, the amount of the abrasive grit particles comprises from at least at least 5 wt % to not greater than 70 wt % of the abrasive aggregate.

The abrasive grit particles can be in a particular size range, conform to a particular size distribution, or a combination thereof. In an embodiment, the abrasive grit particles can be in a size range of not less than 1 micron and not greater than 2000 microns. In a particular embodiment, the abrasive grit particles are in a size range from 50 microns to 1500 microns.

The amount of the anti-wear composition in an abrasive aggregate can vary. In an embodiment, the anti-wear composition can comprises at least 0.5 wt % of the abrasive aggregate, such as at least 1 wt %, such as at least 2 wt %, at least 3 wt %, at least 4 wt %, at least 5 wt %, at least 7 wt %, at least 10 wt %, or at least 15 wt % of the abrasive aggregate. In another embodiment, the anti-wear composition comprises not greater than 40 wt % of the abrasive aggregate, such as not greater than 35 wt %, not greater than 30 wt %, or not greater than 25 wt % of the abrasive aggregate. The amount of the anti-wear composition can be within a range of any minimum or maximum value noted above. In a specific embodiment, the amount of the anti-wear composition comprises from at least 0.5 wt % to not greater than 50 wt % of the abrasive aggregate.

The abrasive aggregates can be in a particular size range, conform to a particular size distribution, or a combination thereof. In an embodiment, the abrasive aggregates can be in a range of not less than 20 micron to not greater than 4000 microns. In a particular embodiment, the abrasive aggregates are in a size range from 50 microns to 2000 microns.

In an embodiment, the abrasive aggregate can include a vitreous aggregate binder composition (also referred to herein as a glass binder composition, glass bond composition, or glass bond). The vitreous binder composition is a glass composition that can comprise acidic oxides, amphoteric oxides, alkali oxides, neutral oxides, or a combination thereof. Acidic oxides are oxides having the general formula RO or RO2, where R is a metal or transition metal moiety. Acidic oxides can include silicon dioxide (silica) ($SiO_2$), manganese (IV) oxide ($MnO_2$), molybdenum trioxide (molybdite) ($MoO_3$), phosphorus pentoxide ($P_2O_5$), titanium dioxide (titania) ($TiO_2$), vanadium (V) oxide ($V_2O_5$), and zirconium dioxide ($ZrO_2$), or combinations thereof. Alkali (also known as "basic oxides" or "flux") are oxides having the formula $R_xO$, where R is a metal or transition metal moiety. In an embodiment, alkali oxides can include cobalt (II) oxide (CoO), copper (II) oxide (cupric oxide)(CuO), nickel (II) oxide (NiO), strontium oxide (strontia) (SrO), magnesium oxide (magnesia) (MgO), calcium oxide (calcia) (CaO), lithium oxide (lithia) ($Li_2O$), barium oxide (baria) (BaO), zinc oxide (calamine)(ZnO), sodium oxide ($Na_2O$), potassium oxide (potash) ($K_2O$), and combinations thereof. Amphoteric oxides are oxides having the general formula $R_2O_3$, where R is a metal or transition metal moiety. In an embodiment, amphoteric species can include boron trioxide (boria) ($B_2O_3$), chromium (III) oxide (chromia) ($Cr_2O_3$), yttrium (III) oxide (yttria) ($Y_2O_3$), iron (III) oxide ($Fe_2O_3$), and aluminum oxide (alumina) ($Al_2O_3$), and combinations thereof. The amount of acidic oxides, basic oxides and amphoteric oxides in the vitreous binder composition can vary. The vitreous aggregate binder composition can possess a particular amount of transition metal, which can vary. The vitreous binder composition can have a particular glass transition temperature, sintering temperature, or combination thereof. The abrasive aggregates can possess one or more beneficial and characteristic properties, such as loose pack density (g/cm$^3$), porosity (vol %) (as measured before and/or after impregnation with a anti-wear composition), crush strength (crush % at specific pressure).

In an embodiment, the abrasive aggregate can include a polymeric resin aggregate binder composition. In an embodiment, the polymeric resin aggregate binder composition can comprise a phenolic polymeric composition, such as a phenolic resole composition; a urea formaldehyde composition; a urethane composition; an epoxy composition; a polyimide composition; a polyamide composition; a polyester composition; an acrylate composition, a protein based composition, a starch based composition, or any combination thereof. In a specific embodiment, the polymeric resin aggregate binder composition can comprise a phenolic polymeric composition.

Backing Material

The backing material (also referred to herein as "a backing") can be flexible or rigid. The backing can be made of any number of various materials including those conventionally used as backings in the manufacture of coated abrasives. An exemplary flexible backing includes a polymeric film (for example, a primed film), such as polyolefin film (e.g., polypropylene including biaxially oriented polypropylene), polyester film (e.g., polyethylene terephthalate), polyamide film, or cellulose ester film; metal foil; mesh; foam (e.g., natural sponge material or polyurethane foam); cloth (e.g., cloth made from fibers or yarns comprising polyester, nylon, silk, cotton, poly-cotton, rayon, or combinations thereof); paper; vulcanized paper; vulcanized rubber; vulcanized fiber; nonwoven materials; a combination thereof; or a treated version thereof. Cloth backings can be woven or stitch bonded. In particular examples, the backing is selected from the group consisting of paper, polymer film, cloth (e.g., cotton, poly-cotton, rayon, polyester, poly-nylon), vulcanized rubber, vulcanized fiber, metal foil and a combination thereof. In other examples, the backing includes polypropylene film or polyethylene terephthalate (PET) film. In other embodiments, the backing material is a paper backing. The paper can be a single ply paper or a multi-ply paper, such as a laminate paper. The paper can be saturated or unsaturated.

The backing can optionally have at least one of a saturant, a presize layer (also called a "front fill layer"), or a backsize layer (also called a "back fill layer"). The purpose of these layers is typically to seal the backing or to protect yarn or fibers in the backing. If the backing is a cloth material, at least one of these layers is typically used. The addition of the presize layer or backsize layer can additionally result in a "smoother" surface on either the front or the back side of the backing. Other optional layers known in the art can also be used such as a tie layer.

The backing can be a fibrous reinforced thermoplastic such as described, for example, in U.S. Pat. No. 5,417,726 (Stout et al.), or an endless spliceless belt, as described, for example, in U.S. Pat. No. 5,573,619 (Benedict et al) Likewise, the backing can be a polymeric substrate having hooking stems projecting therefrom such as that described, for example, in U.S. Pat. No. 5,505,747 (Chesley et al.). Similarly, the backing can be a loop fabric such as that described, for example, in U.S. Pat. No. 5,565,011 (Follett et al.).

Abrasive Layer

The abrasive layer comprises a plurality of abrasive particles disposed on, or dispersed in, a polymeric binder composition (commonly known as a make coat). In an embodiment, an abrasive layer includes abrasive particles disposed on, or dispersed in, a binder composition. In an embodiment, the abrasive layer can include a further polymeric composition (commonly known as a size coat) disposed over the make coat.

Abrasive Particles

Abrasive particles can include essentially single phase inorganic materials, such as alumina, silicon carbide, silica, ceria, and harder, high performance superabrasive particles such as cubic boron nitride and diamond. Additionally, the abrasive particles can include composite particulate materials. Such materials can include aggregates, which can be formed through slurry processing pathways that include removal of the liquid carrier through volatilization or evaporation, leaving behind unfired ("green") aggregates, that can optionally undergo high temperature treatment (i.e., firing, sintering) to form usable, fired aggregates. Further, the abrasive regions can include engineered abrasives including macrostructures and particular three-dimensional structures.

In an embodiment, the abrasive particles are blended with the binder formulation to form abrasive slurry. Alternatively, the abrasive particles are applied over the binder formulation after the binder formulation is coated on the backing. Optionally, a functional powder can be applied over the abrasive regions to prevent the abrasive regions from sticking to a patterning tooling. Alternatively, patterns can be formed in the abrasive regions absent the functional powder.

The abrasive particles can be formed of any one of or a combination of abrasive particles, including silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery. For example, the abrasive particles can be selected from a group consisting of silica, alumina, zirconia, silicon carbide, silicon nitride, boron nitride, garnet, diamond, co-fused alumina zirconia, ceria, titanium diboride, boron carbide, flint, emery, alumina nitride, and a blend thereof. Particular embodiments have been created by use of dense abrasive particles comprised principally of alpha-alumina.

The abrasive grain can also have a particular shape. An example of such a shape includes a rod, a triangle, a pyramid, a cone, a solid sphere, a hollow sphere, or the like. Alternatively, the abrasive grain can be randomly shaped.

In an embodiment, the abrasive particles can have an average particle size not greater than 2000 microns, such as not greater than about 1500 microns, not greater than about 1000 microns, not greater than about 750 microns, or not greater than 500 microns. In another embodiment, the abrasive particle size is at least 0.1 microns, at least 1 microns, at least 5 microns, at least 10 microns, at least 25 microns, or at least 45 microns. In another embodiment, the abrasive particles size is from about 0.1 microns to about 2000 microns. The particle size of the abrasive particles is typically specified to be the longest dimension of the abrasive particle. Generally, there is a range distribution of particle sizes. In some instances, the particle size distribution is tightly controlled.

Make Coat—Binder Composition

The binder composition (commonly known as the make coat) can be formed of a single polymer or a blend of polymers. The binder composition can be formed from an epoxy composition, acrylic composition, a phenolic composition, a polyurethane composition, a phenolic composition, a polysiloxane composition, or combinations thereof. In addition, the binder composition can include tribological performance enhancing composition, as described above, additives, or a combination thereof. In addition, the binder composition can include active filler particles, additives, or a combination thereof, as described herein.

The binder composition generally includes a polymer matrix, which binds abrasive particles to the backing or to a compliant coat, if such a compliant coat is present. Typically, the binder composition is formed of cured binder formulation. In an embodiment, the binder formulation includes a polymer component and a dispersed phase.

The binder formulation can include one or more reaction constituents or polymer constituents for the preparation of a polymer. A polymer constituent can include a monomeric molecule, a polymeric molecule, or a combination thereof. The binder formulation can further comprise components selected from the group consisting of solvents, plasticizers, chain transfer agents, catalysts, stabilizers, dispersants, curing agents, reaction mediators and agents for influencing the fluidity of the dispersion.

The polymer constituents can form thermoplastics or thermosets. By way of example, the polymer constituents can include monomers and resins for the formation of polyurethane, polyurea, polymerized epoxy, polyester, polyimide, polysiloxanes (silicones), polymerized alkyd, styrene-butadiene rubber, acrylonitrile-butadiene rubber, polybutadiene, or, in general, reactive resins for the production of thermoset polymers. Another example includes an acrylate or a methacrylate polymer constituent. The precursor polymer constituents are typically curable organic material (i.e., a polymer monomer or material capable of polymerizing or cros slinking upon exposure to heat or other sources of energy, such as electron beam, ultraviolet light, visible light, etc., or with time upon the addition of a chemical catalyst, moisture, or other agent which cause the polymer to cure or polymerize). A precursor polymer constituent example includes a reactive constituent for the formation of an amino polymer or an aminoplast polymer, such as alkylated urea-formaldehyde polymer, melamine-formaldehyde polymer, and alkylated benzoguanamine-formaldehyde polymer; acrylate polymer including acrylate and methacrylate polymer, alkyl acrylate, acrylated epoxy, acrylated urethane, acrylated polyester, acrylated polyether, vinyl ether, acrylated oil, or acrylated silicone; alkyd polymer such as urethane alkyd polymer; polyester polymer; reactive urethane polymer; phenolic polymer such as resole and novolac polymer; phenolic/latex polymer; epoxy polymer such as bisphenol epoxy polymer; isocyanate; isocyanurate; polysiloxane polymer including alkylalkoxysilane polymer; or reactive vinyl polymer. The binder formulation can include a monomer, an oligomer, a polymer, or a combination thereof. In a particular embodiment, the binder formulation includes monomers of at least two types of polymers that when cured can cros slink. For example, the binder formulation can include epoxy constituents and acrylic constituents that when cured form an epoxy/acrylic polymer.

Size Coat

The coated abrasive article can comprise a size coat disposed on the abrasive layer. The size coat can be the same as or different from the polymer binder composition used to form the size coat of the abrasive layer. The size coat can comprise any conventional compositions known in the art that can be used as a size coat. The size coat can include one or more additives.

Supersize Coat

The coated abrasive article can comprise a supersize coat disposed on the size coat. The supersize coat can be the same as or different from the polymer binder composition of the binder composition of the make coat. In a specific embodiment, the supersize coat can comprise comprises an acetate composition, such as polyvinyl acetate; a phenolic polymeric composition, such as a phenolic resole composition; a urea formaldehyde composition; a melamine composition; a urethane composition; an epoxy composition; a polyimide composition; a polyamide composition; a polyester composition; an acrylate composition, such as a UV curable acrylate composition, or a zinc cross-linked acrylic composition; a rubber composition, such as a styrene butadiene rubber; a protein based composition; a starch based composition, or a combination thereof. In a particular embodiment, the supersize coat composition comprises a tribological performance enhancing composition, as described above. In yet another embodiment, the supersize coat can include one or more additives in addition to the tribological performance enhancing composition. In yet another embodiment, the supersize coat composition can comprise a sulfide scavenging composition. In a particular embodiment, the supersize coat can include one or more additives in addition to the sulfide scavenging composition. In yet another embodiment, the supersize coat composition can comprise an anti-wear composition. In a particular embodiment, the supersize coat can include one or more additives in addition to the anti-wear composition.

Additives

The make coat, size coat, or supersize coat can include one or more additives. Suitable additives can include grinding aids, fibers, lubricants, wetting agents, thixotropic materials, surfactants, thickening agents, pigments, dyes, anti-static agents, coupling agents, plasticizers, suspending agents, pH modifiers, adhesion promoters, lubricants, bactericides, fungicides, flame retardants, degassing agents, anti-dusting agents, dual function materials, initiators, chain transfer agents, stabilizers, dispersants, reaction mediators, colorants, and defoamers. The amounts of these additive materials can be selected to provide the properties desired. These optional additives can be present in any part of the overall system of the coated abrasive product according to embodiments of the present disclosure. Suitable grinding aids can be inorganic based, such as halide salts, for example cryolite, wollastonite, and potassium fluoroborate; or organic based, such as sodium lauryl sulphate, or chlorinated waxes, such as polyvinyl chloride. In an embodiment, the grinding aid can be an environmentally sustainable material.

EMBODIMENTS

Embodiment 1. A fixed abrasive article comprising: a substrate; an abrasive layer disposed on the substrate, wherein the abrasive layer comprises a plurality of abrasive particles disposed on or in a polymeric make coat binder composition; and a size coat disposed over the abrasive layer, wherein the size coat comprises a polymeric size coat binder composition, and a supersize coat disposed over the size coat, wherein the supersize coat comprises a tribological performance enhancing composition disposed on or in the polymeric supersize coat binder composition.

Embodiment 2. The fixed abrasive article of embodiment 1, wherein the tribological performance enhancing composition comprises a mixture of boric acid ($B(OH)_3$) or a borate compound, and a zinc compound.

Embodiment 3. The fixed abrasive article of embodiment 2, wherein the performance enhancing mixture further comprises a polyphosphate ester.

Embodiment 4. The fixed abrasive article of embodiment 2, wherein the performance enhancing mixture further comprises a hypophosphite salt.

Embodiment 5. The fixed abrasive article of embodiment 2, wherein the performance enhancing mixture further comprises cellulose.

Embodiment 6. The fixed abrasive article of embodiment 2, wherein the supersize coat comprises: 40-70 wt % of a polymeric supersize coat binder composition, 20-40 wt % of boric acid ($B(OH)_3$) or a borate compound, and 10-30 wt % of a zinc salt.

Embodiment 7. The fixed abrasive article of embodiment 6, wherein the supersize coat further comprises: 10-30 wt % of a polyphosphate ester.

Embodiment 8. The fixed abrasive article of embodiment 6, wherein the supersize coat further comprises: 1-30 wt % of a hypophosphite salt.

Embodiment 9. The fixed abrasive article of embodiment 6, wherein the performance enhancing mixture further comprises: 0.1-5 wt % cellulose based thickener.

Embodiment 10. The fixed abrasive of embodiment 2, wherein the zinc compound comprises zinc borate, zinc phosphate, zinc stearate, zinc ammonium carbonate, sodium zinc polyphosphate, or a combination thereof.

Embodiment 11. The fixed abrasive of embodiment 2, wherein the borate comprises potassium tetraborate, potassium pentaborate; ammonium pentaborate, calcium borate (colemanite), sodium borate (borax), tourmaline (borosilicate with aluminum), kernite (hydrated sodium borate), ulexite (hydrated sodium calcium hydroxide), howlite (borosilicate), meherhoffite (calcium silicon borate) or a combination thereof.

Embodiment 12. The fixed abrasive of embodiment 3, wherein the polyphosphate ester comprises Polyphosphate Ester ("PPE"), a polyether phosphate ester, an amine salt of polyether phosphate, or any combination thereof.

Embodiment 13. The fixed abrasive of embodiment 4, wherein the hypophosphite salt comprises sodium hypophosphite ($NaPO_2H_2$) or potassium hypophosphite, or a combination thereof.

Embodiment 14. The fixed abrasive article of embodiment 1, wherein the tribological performance enhancing composition comprises a Fischer-Tropsch hydrocarbon product.

Embodiment 15. The fixed abrasive article of embodiment 14, wherein the Fischer-Tropsch hydrocarbon product comprises a Fischer-Tropsch wax.

Embodiment 16. The fixed abrasive article of embodiment 14, wherein the Fischer-Tropsch hydrocarbon product comprises a wax emulsion.

Embodiment 17. The fixed abrasive article of embodiment 14, wherein the Fischer-Tropsch hydrocarbon product comprises a Fischer-Tropsch synthetic crude oxygenate (i.e., an oxygenated hydrocarbon product resulting from a synthetic crude processed by the Fischer-Tropsch process).

Embodiment 18. The fixed abrasive article of embodiment 17, wherein the Fischer-Tropsch synthetic crude oxygenate comprises a an alcohol, an aldehyde, a carboxylic acid, a ketone, or any combination thereof having an aliphatic carbon chain of 4 to 40 carbon atoms, such as from 5 to 30 carbon atoms, such as from 8 to 25 carbon atoms.

Embodiment 19. The fixed abrasive article of embodiment 1, wherein the tribological performance enhancing composition comprises a grinding aid aggregate comprising a polymeric binder composition and potassium fluoroborate, cryolite, or a combination thereof.

Embodiment 20. The fixed abrasive article of embodiment 19, wherein the grinding aid aggregate comprises: 60-99 wt % of potassium fluoroborate, cryolite, or a combination thereof; and 1-40 wt % of polymeric binder composition.

Embodiment 21. The fixed abrasive article of embodiment 20, wherein the polymeric binder composition comprises a phenolic polymeric composition, such as a phenolic resole composition; a urea formaldehyde composition; a urethane composition; an epoxy composition; a polyimide composition; a polyamide composition; a polyester composition; an acrylate composition, a protein based composition, a starch based composition, or any combination thereof.

Embodiment 22. The fixed abrasive article of embodiment 19, comprising a ratio of average aggregate size to average abrasive grain size in a range of 1:10 to 10:1.

Embodiment 23: The fixed abrasive article of embodiment 19, comprising a ratio of abrasive grain weight (lbs/ream) to average aggregate weight (lbs/ream) in a range of 10:1 to 1:1.

Embodiment 24. The fixed abrasive of embodiment 1, wherein the tribological performance enhancing composition is essentially free of sulfur.

Embodiment 25. The fixed abrasive of embodiment 1, wherein the supersize coat polymeric composition comprises an acetate composition, such as polyvinyl acetate; a phenolic polymeric composition, such as a phenolic resole composition; a urea formaldehyde composition; melamine resin composition; a urethane composition; an epoxy composition; a polyimide composition; a polyamide composition; a polyester composition; an acrylate composition, such as a UV curable acrylate, or a zinc cross-linked acrylic composition; a rubber composition, such as a styrene butadiene rubber; a protein based composition; a starch based composition, or a combination thereof.

Embodiment 26. A fixed abrasive article comprising: a substrate; a abrasive layer disposed on the substrate, wherein the abrasive layer comprises a plurality of aggregates disposed on or in a polymeric make coat binder composition; a size coat disposed over the abrasive layer, wherein the size coat comprises a polymeric size coat binder composition, and a supersize coat disposed over the size coat, wherein the supersize coat comprises a sulfide scavenging composition disposed on or in a polymeric supersize coat binder composition.

Embodiment 27. The fixed abrasive article of embodiment 26, wherein the aggregate comprises: a plurality of particles bound together by an aggregate binder composition, and an anti-wear composition disposed in contact with the particles and the aggregate binder composition, wherein the anti-wear composition comprises a thiophosphate compound.

Embodiment 28. The fixed abrasive article of embodiment 27, wherein the anti-wear composition comprises a coating disposed over the surface of each particle.

Embodiment 29. The fixed abrasive article of embodiment 27, wherein the anti-wear composition comprises a coating that envelopes each particle.

Embodiment 30. The fixed abrasive article of embodiment 28, wherein the coating is disposed between the particle and the aggregate binder composition.

Embodiment 31. The fixed abrasive article of embodiment 28, wherein the aggregate binder composition comprises a continuous phase.

Embodiment 32. The fixed abrasive article of embodiment 27, wherein the aggregate binder composition comprises an organic polymeric composition.

Embodiment 33. The fixed abrasive article of embodiment 27, wherein the aggregate binder composition comprises a bond interface between the particles that joins the particles together.

Embodiment 34. The fixed abrasive article of embodiment 27, wherein the aggregate binder composition is disposed between the particles.

Embodiment 35. The fixed abrasive article of embodiment 27, wherein the bond interface comprises bond posts at points of contact between the particles.

Embodiment 36. The fixed abrasive article of embodiment 33, wherein the aggregate binder comprises a discontinuous phase.

Embodiment 37. The fixed abrasive article of embodiment 27, wherein the aggregate binder composition comprises a vitreous binder composition.

Embodiment 38. The fixed abrasive article of embodiment 27, wherein the anti-wear composition comprises 0.5 to 40 wt % of the aggregate.

Embodiment 39. The fixed abrasive article of embodiment 27, wherein the aggregate binder composition comprises 0.5 to 50 wt % of the aggregate.

Embodiment 40. The fixed abrasive article of embodiment 27, wherein the plurality of particles comprises 5 to 70 wt % of the aggregate.

Embodiment 41. The fixed abrasive article of embodiment 27, wherein the anti-wear composition comprises a thiophosphate ester, a dithiophosphate ester, or a combination thereof.

Embodiment 42. The fixed abrasive article of embodiment 41, wherein the thiophosphate includes zinc.

Embodiment 43. The fixed abrasive article of embodiment 42, wherein the thiophosphate comprises a zinc dithiophosphate (ZDP), a zinc dialkyl dithiophosphate (ZDDP), a tricresyl phosphate (TCP), or a combination thereof.

Embodiment 44. The fixed abrasive article of embodiment 43, wherein the ZDDP comprises monomeric ZDDP, dimeric ZDDP, tetrameric ZDDP, polymeric ZDDP, or a combination thereof.

Embodiment 45. The fixed abrasive article of embodiment 27, wherein the anti-wear composition further comprises a lubricant composition.

Embodiment 46. The fixed abrasive article of embodiment 45, wherein the lubricant composition comprises a paraffinic material, an oil, a wax, a grease, or a combination thereof.

Embodiment 47. The fixed abrasive article of embodiment 46, wherein the paraffinic material comprises a liquid paraffin, a solid paraffin, or a combination thereof.

Embodiment 48. The fixed abrasive article of embodiment 46, wherein the oil comprises a vegetable oil, a mineral oil, an animal oil, a synthetic oil, or a combination thereof.

Embodiment 49. The fixed abrasive article of embodiment 46, wherein the oil comprises a distillate of petroleum.

Embodiment 50. The fixed abrasive article of embodiment 27, wherein the anti-wear composition further comprises a fixative composition.

Embodiment 51. The fixed abrasive article of embodiment 50, wherein the fixative composition comprises a polymeric resin.

Embodiment 52. The fixed abrasive article of embodiment 51, wherein the polymeric resin comprises an acetate composition, such as polyvinyl acetate; a phenolic polymeric composition, such as a phenolic resole composition; a urea formaldehyde composition; melamine resin composition; a urethane composition; an epoxy composition; a polyimide composition; a polyamide composition; a polyester composition; an acrylate composition, such as a UV curable acrylate, or a zinc cross-linked acrylic composition; a rubber composition, such as a styrene butadiene rubber; a protein based composition; a starch based composition, or a combination thereof.

Embodiment 53. The fixed abrasive article of embodiment 27, wherein the plurality of particles comprises abrasive particles.

Embodiment 54. The fixed abrasive article of embodiment 53, wherein the abrasive particles comprise silica, alumina, zirconia, silicon carbide, silicon nitride, boron nitride, garnet, diamond, co-fused alumina zirconia, ceria, titanium diboride, boron carbide, flint, emery, alumina nitride, or a combination thereof.

Embodiment 55. The fixed abrasive article of embodiment 53, wherein the abrasive particles include shaped abrasive particles or random (crushed) abrasive particles.

Embodiment 56. The fixed abrasive article of embodiment 54, wherein the shaped abrasive particles comprise a particular shape selected from a rod, a triangle, a pyramid, a cone, a solid sphere, a hollow sphere, or a combination thereof.

Embodiment 57. The aggregate of embodiment 27, wherein the aggregate comprises an average particle size not less than 20 microns and not greater than 4000 microns.

Embodiment 58. The fixed abrasive article of embodiment 27, wherein the anti-wear composition comprises: 0.01 to 90 wt % of anti-wear agent; and 1.0 to 90 wt % of fixative composition.

Embodiment 59. The fixed abrasive article of embodiment 58, wherein the anti-wear composition further comprises 1.0 to 90 wt % of a lubricant composition.

Embodiment 60. The fixed abrasive article of embodiment 26, wherein the sulfide scavenging composition comprises: a transition metal salt, a gluconate, glyoxal, a polyphosphate, or a combination thereof.

Embodiment 61. The fixed abrasive article of embodiment 26, wherein the transition metal salt is a titanium salt, a manganese salt, an iron salt, a nickel salt, a copper salt, a zinc salt, or a combination thereof.

Embodiment 62. The fixed abrasive article of embodiment 26, wherein the transition metal salt comprises a transition metal oxide, a transition metal carbonate, a transition metal borate, a transition metal phosphate, or a combination thereof.

Embodiment 63. The fixed abrasive article of embodiment 60, wherein the transition metal salt comprises zinc oxide, zinc carbonate, zinc stearate, zinc borate, zinc naphthenate, or a combination thereof.

Embodiment 64. The fixed abrasive article of embodiment 60, wherein the transition metal salt comprises iron oxide.

Embodiment 65. The fixed abrasive article of embodiment 60, wherein the gluconate comprises ferrous gluconate.

Embodiment 66. A fixed abrasive article comprising: a substrate; an abrasive layer disposed on the substrate, wherein the abrasive layer comprises a plurality of abrasive particles disposed on or in a polymeric make coat binder composition; and a size coat disposed over the abrasive layer, wherein the size coat comprises a polymeric size coat binder composition, and a supersize coat disposed over the size coat, wherein the supersize coat comprises a tribological performance enhancing composition disposed on or in a polymeric supersize coat binder composition.

Embodiment 67. The fixed abrasive article of embodiment 66, wherein the tribological performance enhancing composition comprises a performance enhancing mixture of boric acid ($B(OH)_3$) or a borate compound; and a zinc compound.

Embodiment 68. The fixed abrasive article of embodiment 67, wherein the performance enhancing mixture further comprises a polyphosphate ester.

Embodiment 69. The fixed abrasive article of embodiment 67, wherein the performance enhancing mixture further comprises a hypophosphite salt Embodiment 70. The fixed abrasive article of embodiment 67, wherein the performance enhancing mixture further comprises cellulose.

Embodiment 71. The fixed abrasive of embodiment 67, wherein the zinc compound comprises zinc borate, zinc phosphate, zinc stearate, zinc ammonium carbonate, sodium zinc polyphosphate, or a combination thereof.

Embodiment 72. The fixed abrasive of embodiment 67, wherein the borate compound comprises potassium tetraborate, potassium pentaborate; ammonium pentaborate, calcium borate (colemanite), sodium borate (borax), tourmaline (borosilicate with aluminum), kernite (hydrated sodium borate), ulexite (hydrated sodium calcium hydroxide), howlite (borosilicate), meherhoffite (calcium silicon borate) or a combination thereof.

Embodiment 73. The fixed abrasive article of embodiment 66, wherein the tribological performance enhancing composition comprises a Fischer-Tropsch hydrocarbon product.

Embodiment 74. A fixed abrasive article comprising: a substrate; an abrasive layer disposed on the substrate, and a size coat disposed over the abrasive layer, wherein the size coat comprises a polymeric size coat binder composition, wherein a grinding aid aggregate is disposed in the abrasive layer, and wherein the grinding aid aggregate comprises a polymeric binder composition and potassium fluoroborate, cryolite, or a combination thereof.

Embodiment 75. The fixed abrasive article of embodiment 9, wherein the grinding aid aggregate comprises: 60-99 wt % of potassium fluoroborate, cryolite, or a combination thereof; and 1-40 wt % of polymeric binder composition.

Embodiment 76. The fixed abrasive of embodiment 66, wherein the tribological performance enhancing composition is essentially free of sulfur.

Embodiment 77. A fixed abrasive article comprising: a substrate; an abrasive layer disposed on the substrate, a size coat disposed over the abrasive layer, wherein the size coat comprises a polymeric size coat binder composition, and a supersize coat disposed over the size coat, wherein the supersize coat comprises a sulfide scavenging composition disposed on or in a polymeric supersize coat binder composition.

Embodiment 78. The fixed abrasive article of embodiment 77, wherein the sulfide scavenging composition comprises a transition metal salt, a gluconate, glyoxal, a polyphosphate, or a combination thereof.

Embodiment 79. The fixed abrasive article of embodiment 78, wherein the transition metal salt comprises zinc oxide, zinc carbonate, zinc stearate, zinc borate, zinc naphthenate, or a combination thereof.

Embodiment 80. The fixed abrasive article of embodiment 77, wherein the abrasive layer comprises a plurality of abrasive aggregates.

Embodiment 81. The fixed abrasive article of embodiment 80, wherein the abrasive aggregates comprise: a plurality of particles bound together by an aggregate binder composition, and an anti-wear composition disposed in contact with the particles and the aggregate binder composition, wherein the anti-wear composition comprises a thiophosphate compound.

Embodiment 82. The fixed abrasive article of embodiment 81, wherein the aggregate binder composition comprises a vitreous binder composition.

Embodiment 83. The fixed abrasive article of embodiment 81, wherein the anti-wear composition comprises a thiophosphate ester, a dithiophosphate ester, or a combination thereof.

Embodiment 84. The fixed abrasive article of embodiment 83, wherein the thiophosphate includes zinc.

Embodiment 85. The fixed abrasive article of embodiment 83, wherein the thiophosphate comprises a zinc dithiophosphate (ZDP), a zinc dialkyl dithiophosphate (ZDDP), a tricresyl phosphate (TCP), or a combination thereof.

EXAMPLES

Example 1

Performance Enhancing Mixture—Supersize

Tribological enhancing compositions comprising a performance enhancing mixture were prepared according to the details shown in Table 1 and Table 2.

TABLE 1

Supersize Formulations S1-S4 including a Tribological enhancing composition

| | S1 wt % dry/ cured | S2 wt % dry/ cured | S3 wt % dry/ cured | S4 wt % dry/ cured |
|---|---|---|---|---|
| Polyvinyl Acetate[1] | 49.2 | 49.2 | 49.2 | 49.2 |
| Zinc Borate[2] | 49.2 | — | — | 24.6 |
| Boric Acid[3] | — | 49.2 | — | — |
| Ammonium Pentaborate | — | — | 49.2 | — |
| Polyphosphate Ester[4] | — | — | — | 24.6 |
| Surfactant[5] | 0.8 | 0.8 | 0.8 | 0.8 |
| Defoamer[6] | 0.8 | 0.8 | 0.8 | 0.8 |
| Total | 100.0 | 100.0 | 100.0 | 100.0 |

[1]Vycar 1022
[2]Firebrake 415
[3]Optibor TP
[4]Disparalon DA-375
[5]Dynol 604
[6]Deefo 215

TABLE 2

Supersize Formulations S5-S13 including a Tribological enhancing composition

| | S5 wt % dry/ cured | S6 wt % dry/ cured | S7 wt % dry/ cured | S8 wt % dry/ cured | S9 wt % dry/ cured | S10 wt % dry/ cured | S11 wt % dry/ cured | S12 wt % dry/ cured | S13 wt % dry/ cured |
|---|---|---|---|---|---|---|---|---|---|
| Polyvinyl Acetate[1] | 48.8 | 48.8 | 48.8 | 48.8 | 48.8 | 48.4 | 61.2 | 48.1 | 48.1 |
| Boric Acid[2] | 48.8 | — | — | — | — | 24.2 | 30.6 | 24.1 | — |
| Calcium Borate[3] | — | 48.8 | — | — | — | — | — | — | 24.1 |
| Zinc Phosphate[4] | — | — | 48.8 | — | — | — | — | 24.1 | 24.1 |
| Potassium Pentaborate[5] | — | — | — | 48.8 | — | — | — | — | — |

TABLE 2-continued

Supersize Formulations S5-S13 including a Tribological enhancing composition

| | S5 wt % dry/ cured | S6 wt % dry/ cured | S7 wt % dry/ cured | S8 wt % dry/ cured | S9 wt % dry/ cured | S10 wt % dry/ cured | S11 wt % dry/ cured | S12 wt % dry/ cured | S13 wt % dry/ cured |
|---|---|---|---|---|---|---|---|---|---|
| Potassium Tetraborate[6] | — | — | — | — | 48.8 | — | — | — | — |
| Zinc Stearate | — | — | — | — | — | 24.2 | — | — | — |
| Zinc Ammonium Carbonate[7] | — | — | — | — | — | — | 4.6 | — | — |
| Surfactant[8] | 0.8 | 0.8 | 0.8 | 0.8 | 0.8 | 0.7 | 0.8 | 0.8 | 0.8 |
| Defoamer[9] | 0.8 | 0.8 | 0.8 | 0.8 | 0.8 | 0.7 | 0.8 | 0.8 | 0.8 |
| Thickener[10] | 0.7 | 0.7 | 0.7 | 0.7 | 0.7 | 1.8 | 2.1 | 2.1 | 2.1 |
| Total | 100.0 | 100.0 | 100.0 | 100.0 | 100.0 | 100.0 | 100.0 | 100.0 | 100.0 |

[1]Vycar 1022
[2]Optibor TP
[3]Colemanite
[4]K-Pure-CXC-1765; Huntsman PhosGuard J0852
[5]US Borax
[6]US Borax
[7]BASF Zinc Oxide soln#l
[8]Dynol 604
[9]Deefo 215
[10]Nastrol Plus - hydroxyethycellulose

Example 2

Abrasive Performance Testing S1-S4—1026 Carbon Steel

Figure 11:
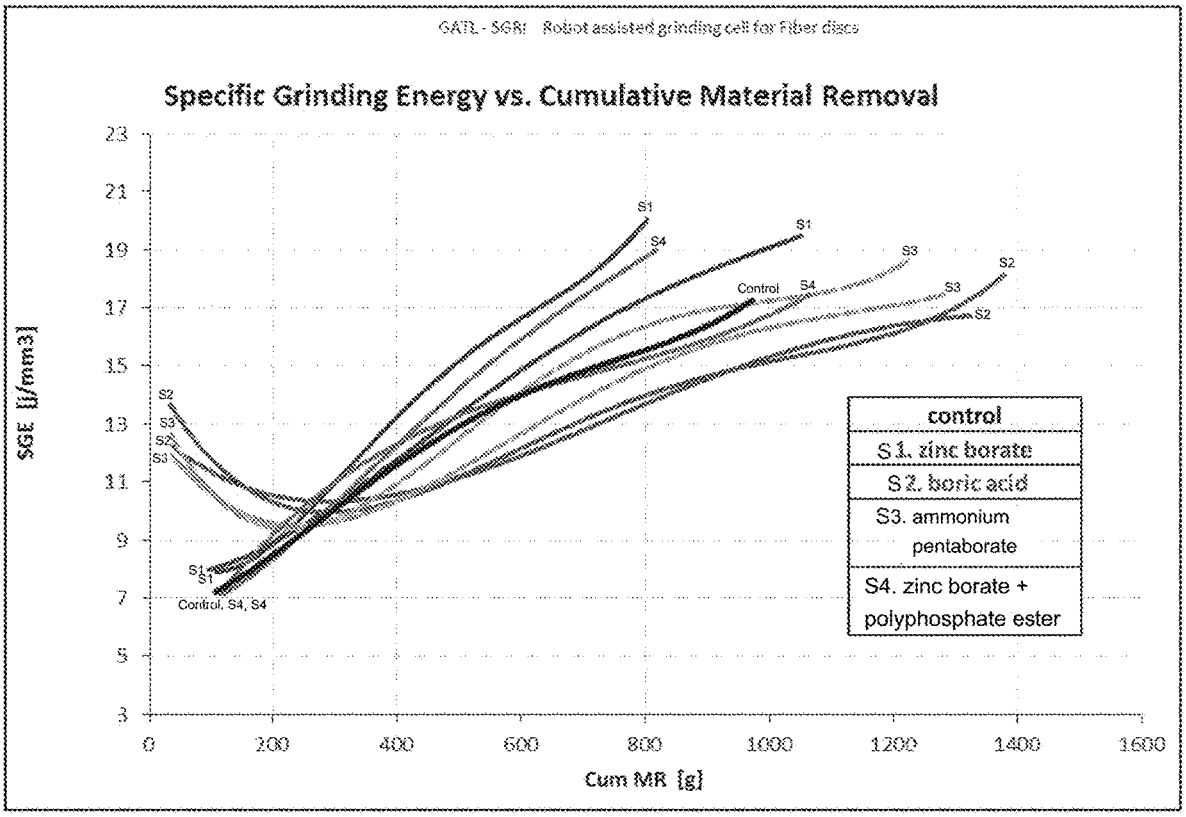
FIG. 11 is a graph showing specific grinding energy ("SGE") versus cumulative material removal by inventive abrasive disc embodiments compared to conventional abrasive discs.

Inventive abrasive discs were successfully prepared that included supersize coats including tribological performance enhancing compositions according to the formulations S1-S4 of Example 1. Abrasive performance testing of the inventive discs and conventional comparative discs was conducted on 1026 carbons steel workpieces. The comparative discs did not have a supersize coating and were used as a control sample. The construction of the abrasive discs and the abrasive performance results are shown in Table 3. The results indicated slightly reduced performance for S1, and increased performance for S2, S3, and S4 formulations. Specific grinding energy ("SGE") was measured during testing and is graphed compared to cumulative material removed as shown in FIG. 11.

TABLE 3

Abrasive Performance S1-S4 on 1026 Carbon Steel

| Sample | Make Coat | Size Coat | Supersize Coat | Avg. Cum. Cut Carbon Steel (As a % of C1) |
|---|---|---|---|---|
| C1 | Control | Control | None | 100% |
| S1 | Control | Control | S1 | 96% |
| S2 | Control | Control | S2 | 138% |
| S3 | Control | Control | S3 | 115% |
| S4 | Control | Control | S4 | 103% |

Example 3

Abrasive Performance Testing S5-S7—IS 2026 Steel

Figure 12A:
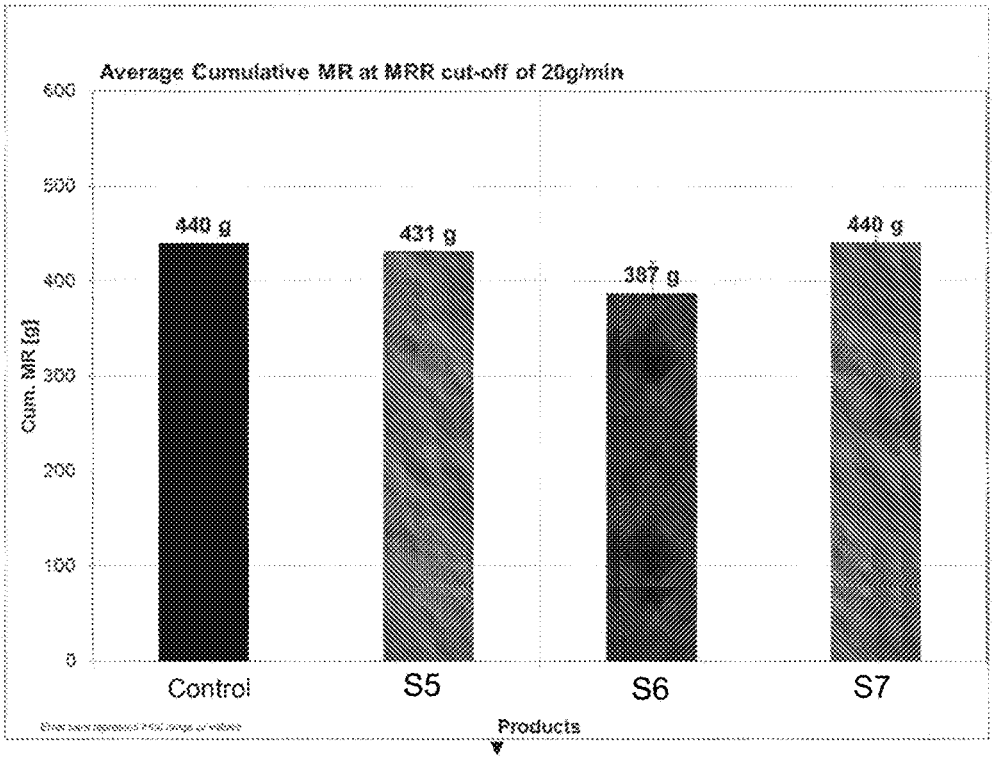
FIG. 12A is a bar graph showing cumulative material removal by inventive abrasive disc embodiments compared to conventional abrasive discs.
Figure 12B:
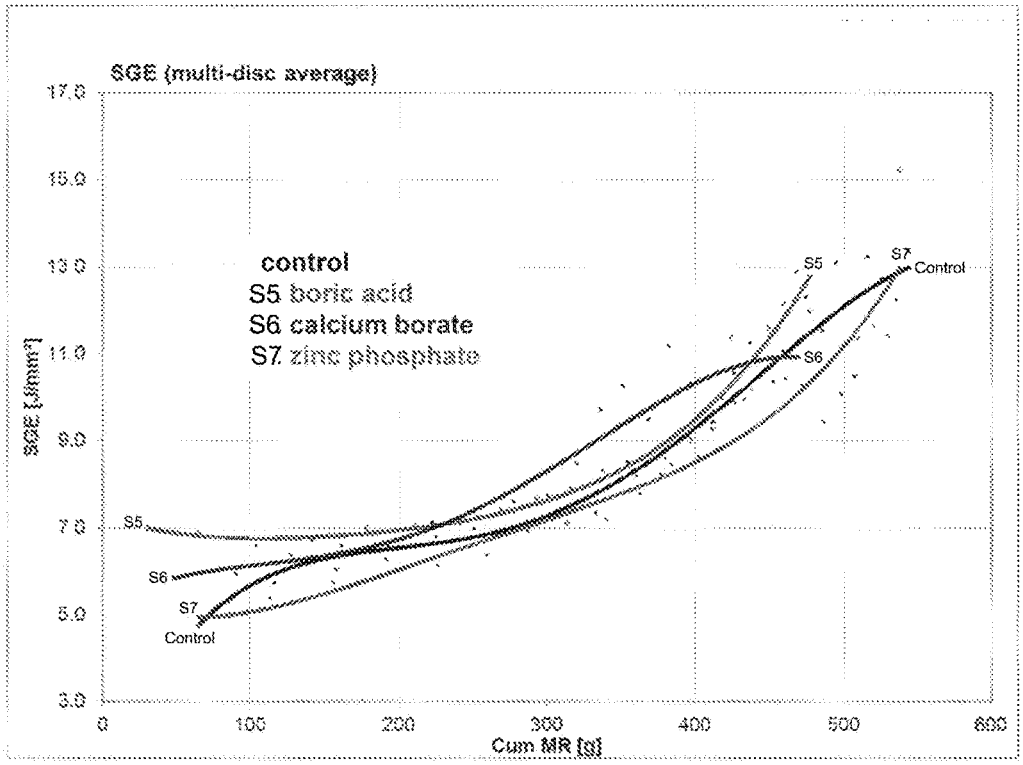
FIG. 12B is a graph showing specific grinding energy ("SGE") versus cumulative material removal by inventive abrasive disc embodiments compared to conventional abrasive discs.

Inventive abrasive discs were successfully prepared that included supersize coats including tribological performance enhancing compositions according to the formulations S5-S7 of Example 1. Abrasive performance testing of the inventive discs and conventional comparative discs was conducted on IS 2062 steel workpieces. The comparative discs did not have a supersize coating and were used as a control sample. The construction of the abrasive discs and the abrasive performance results are shown in Table 4 and also shown in FIG. 12A. The results indicated slightly reduced performance for S5 and S6, and the same performance for S7. Specific grinding energy ("SGE") was measured during testing and is graphed compared to cumulative material removed as shown in FIG. 12B.

TABLE 4

Abrasive Performance S5-S7 on IS 2026 Steel

| Sam-ple | Make Coat | Size Coat | Supersize Coat | Avg. Cum. Cut Carbon Steel (As a % of C1) | Specific Grinding Energy (Compared to Control) |
|---|---|---|---|---|---|
| C1 | Control | Control | None | 100% | N/A |
| S5 | Control | Control | S5 | 98% | Greater than control |
| S6 | Control | Control | S6 | 88% | Greater than control |
| S7 | Control | Control | S7 | 100% | Less than control |

Example 4

Abrasive Performance Testing S7-S13—IS 2062 Steel

Figure 13A:
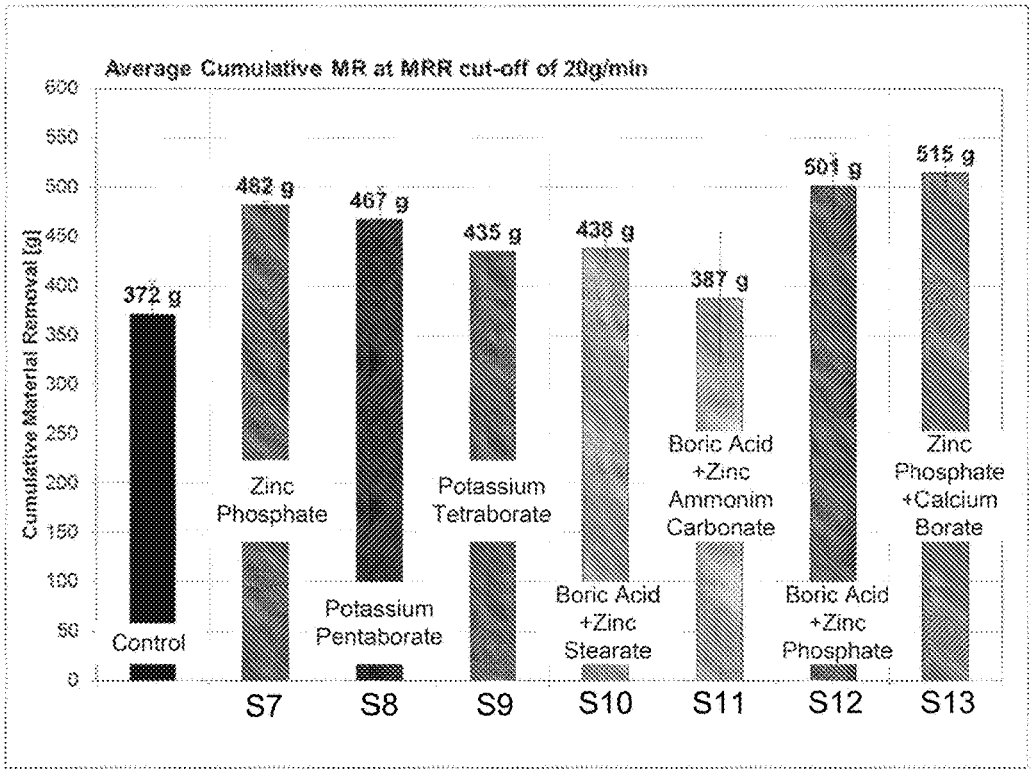
FIG. 13A is a bar graph showing cumulative material removal by inventive abrasive disc embodiments compared to conventional abrasive discs.
Figure 13B:
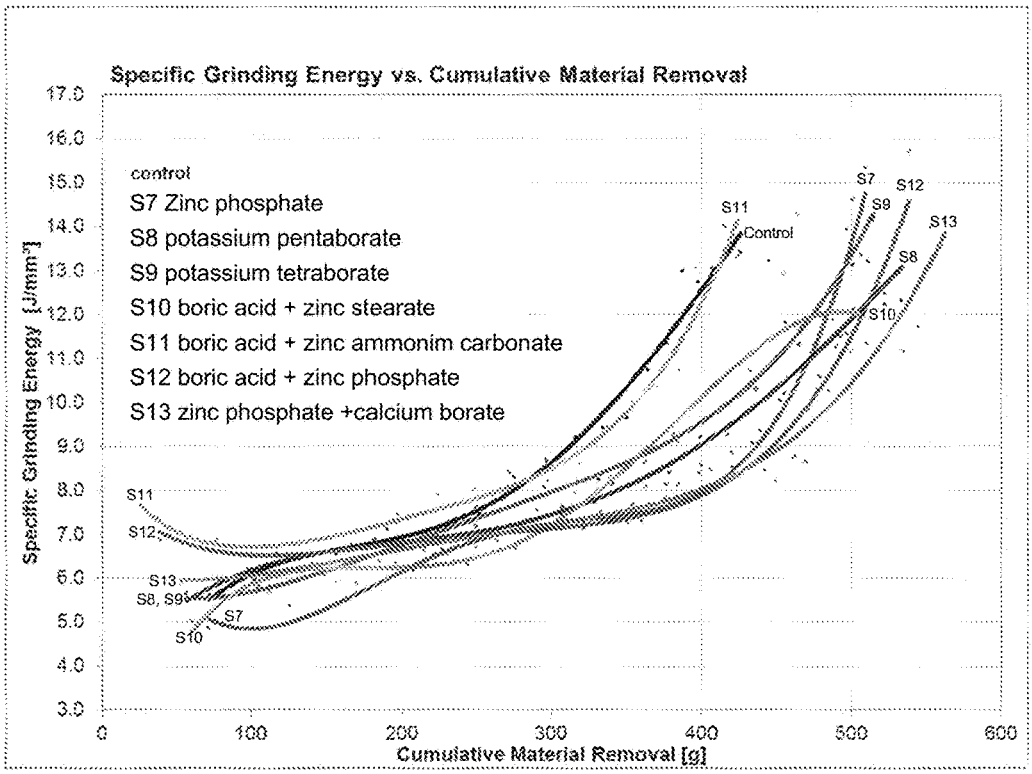
FIG. 13B is a graph showing specific grinding energy ("SGE") versus cumulative material removal by inventive abrasive disc embodiments compared to conventional abrasive discs.

Inventive abrasive discs were successfully prepared that included supersize coats including tribological performance enhancing compositions according to the formulations S7-S13 of Example 1. Abrasive performance testing of the inventive discs and conventional comparative discs was conducted on IS 2062 steel workpieces. The comparative discs did not have a supersize coating and were used as a control sample. The construction of the abrasive discs and the abrasive performance results are shown in Table 5. A bar graph of the cumulative cut results is shown in FIG. 13A and a graph of the SGE versus cumulative cut is shown in FIG. 13B. Unexpectedly and surprisingly, the results indicated beneficial improved abrasive for all inventive samples S7-S13. Again, unexpectedly and surprisingly, the specific grinding energy ("SGE") was reduced or equivalent for all inventive samples S7-S13.

TABLE 5

Abrasive Performance S5-S7 on 1026 Carbon Steel

| Sample | Make Coat | Size Coat | Supersize Coat | Avg. Cum. Cut Carbon Steel (As a % of C1) | Specific Grinding Energy (Compared to Control) |
|---|---|---|---|---|---|
| C1 | Control | Control | None | 100% | N/A |
| S7 | Control | Control | S7 | 130% | Less than control |
| S8 | Control | Control | S8 | 126% | Less than control |
| S9 | Control | Control | S9 | 117% | Less than control |
| S10 | Control | Control | S10 | 118% | Less than control |
| S11 | Control | Control | S11 | 104% | Equivalent to control |
| S12 | Control | Control | S12 | 135% | Less than control |
| S13 | Control | Control | S13 | 138% | Less than control |

Example 5

Abrasive Performance Testing S7, S9, S10, S12—IS 2062 Steel

Figure 23A:
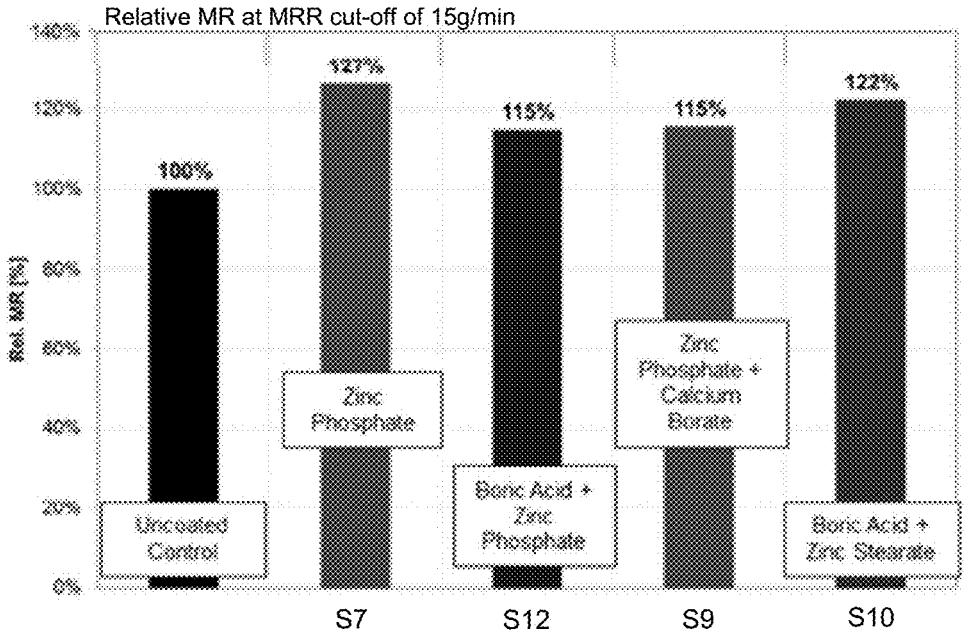
FIG. 23A is a bar graph showing relative material removal by inventive abrasive disc embodiments compared to conventional abrasive discs.
Figure 23B:
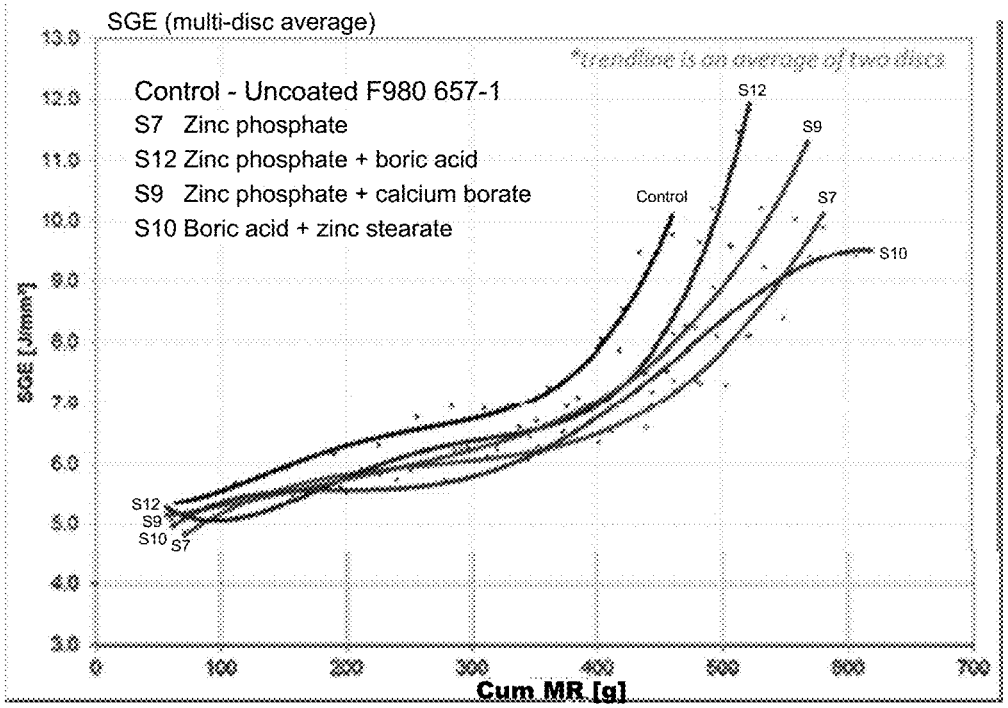
FIG. 23B is a graph showing specific grinding energy ("SGE") versus cumulative material removal by inventive abrasive disc embodiments compared to conventional abrasive discs.

Inventive abrasive discs were successfully prepared that included supersize coats including tribological performance enhancing compositions according to the formulations S7, S9, S10 and S12 of Example 1. Abrasive performance testing of the inventive discs and conventional comparative discs was conducted on IS 2062 steel workpieces. The comparative discs did not have a supersize coating and were used as a control sample. The construction of the abrasive discs and the abrasive performance results are shown in Table 6. A bar graph of the relative cut results is shown in FIG. 23A and a graph of the SGE versus cumulative cut is shown in FIG. 23B. Unexpectedly and surprisingly, the results indicated beneficial improved abrasive for all inventive samples S7, S9, S10 and S12. Again, unexpectedly and surprisingly, the specific grinding energy ("SGE") was reduced or equivalent for all inventive samples S7, S9, S10 and S12.

TABLE 6

Abrasive Performance S7, S9, S10, S12 on IS 2062 Carbon Steel

| Sample | Make Coat | Size Coat | Supersize Coat | Avg. Cum. Cut Carbon Steel (As a % of C1) | Specific Grinding Energy (Compared to Control) |
|---|---|---|---|---|---|
| C1 | Control | Control | None | 100% | N/A |
| S7 | Control | Control | S7 | 127% | Less than control |
| S9 | Control | Control | S9 | 115% | Less than control |
| S10 | Control | Control | S10 | 122% | Less than control |

TABLE 6-continued

Abrasive Performance S7, S9, S10, S12 on IS 2062 Carbon Steel

| Sample | Make Coat | Size Coat | Supersize Coat | Avg. Cum. Cut Carbon Steel (As a % of C1) | Specific Grinding Energy (Compared to Control) |
|---|---|---|---|---|---|
| S12 | Control | Control | S12 | 115% | Less than control |

Example 6

Abrasive Performance Testing S7, S9, S10, S12—Stainless Steel 304LSS

Figure 24A:
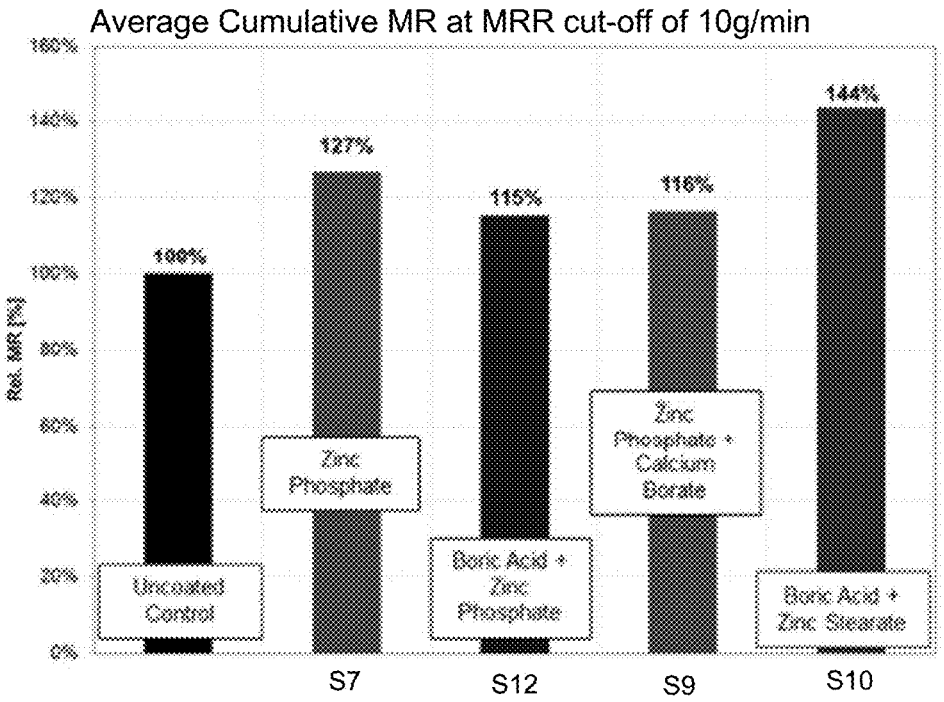
FIG. 24A is a bar graph showing relative material removal by inventive abrasive disc embodiments compared to conventional abrasive discs.
Figure 24B:
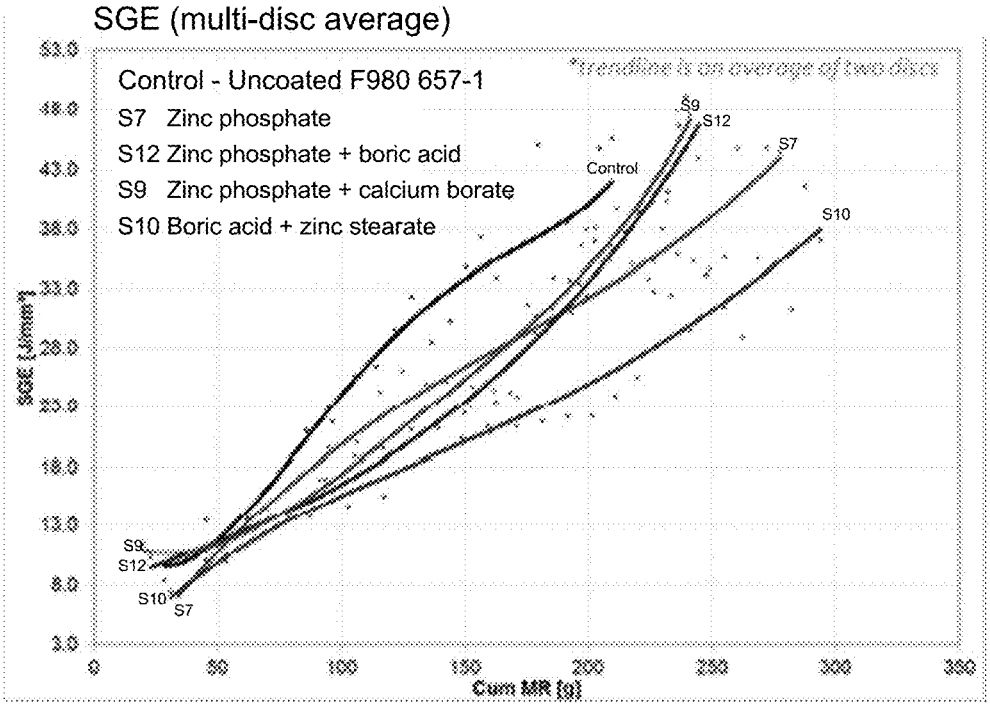
FIG. 24B is a graph showing specific grinding energy ("SGE") versus cumulative material removal by inventive abrasive disc embodiments compared to conventional abrasive discs.

Inventive abrasive discs were successfully prepared that included supersize coats including tribological performance enhancing compositions according to the formulations S7, S9, S10 and S12 of Example 1. Abrasive performance testing of the inventive discs and conventional comparative discs was conducted on 304LSS stainless steel workpieces. The comparative discs did not have a supersize coating and were used as a control sample. The construction of the abrasive discs and the abrasive performance results are shown in Table 7. A bar graph of the relative cut results is shown in FIG. 24A and a graph of the SGE versus cumulative cut is shown in FIG. 24B. Unexpectedly and surprisingly, the results indicated beneficial improved abrasive for all inventive samples S7, S9, S10 and S12. Again, unexpectedly and surprisingly, the specific grinding energy ("SGE") was reduced or equivalent for all inventive samples S7, S9, S10 and S12.

TABLE 7

Abrasive Performance S7, S9, S10, S12 on Stainless Steel 304LSS

| Sample | Make Coat | Size Coat | Supersize Coat | Avg. Cum. Cut Carbon Steel (As a % of C1) | Specific Grinding Energy (Compared to Control) |
|---|---|---|---|---|---|
| C1 | Control | Control | None | 100% | N/A |
| S7 | Control | Control | S7 | 127% | Less than control |
| S9 | Control | Control | S9 | 116% | Less than control |
| S10 | Control | Control | S10 | 144% | Less than control |
| S12 | Control | Control | S12 | 115% | Less than control |

Example 7

Fischer-Tropsch Hydrocarbon Product—Supersize

Tribological enhancing compositions comprising a Fischer-Tropsch hydrocarbon product were prepared according to the details shown in Table 8.

TABLE 8

Supersize Formulation S-14 including a Tribological enhancing composition

| | S14 wt % |
|---|---|
| Polyvinyl Acetate[1] | 44 |
| Fischer-Tropsch Wax Emulsion[2] | 55 |

TABLE 8-continued

| Supersize Formulation S-14 including a Tribological enhancing composition | |
|---|---|
| | S14 wt % |
| Surfactant[3] | 0.5 |
| Defoamer[4] | 0.5 |
| Total | 100.0 |

[1]Vycar 1022
[2]Michem Emulsion 98040M1
[3]Dynol 604
[4]Deefo 215

Example 8

Abrasive Performance Testing S14—1026 Carbon Steel

Figure 14B:
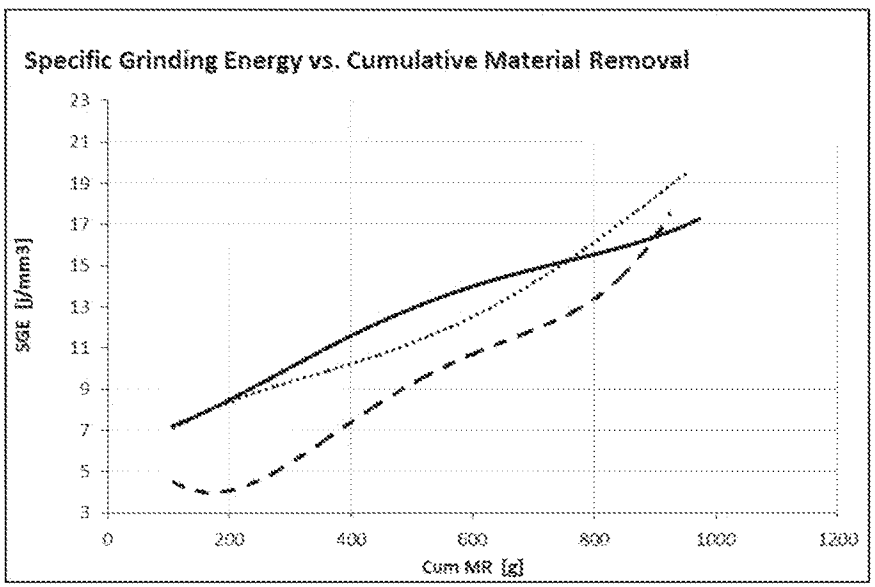
FIG. 14B is a graph showing specific grinding energy ("SGE") versus cumulative material removal by inventive abrasive disc embodiments compared to conventional abrasive discs.
Figure 14A:
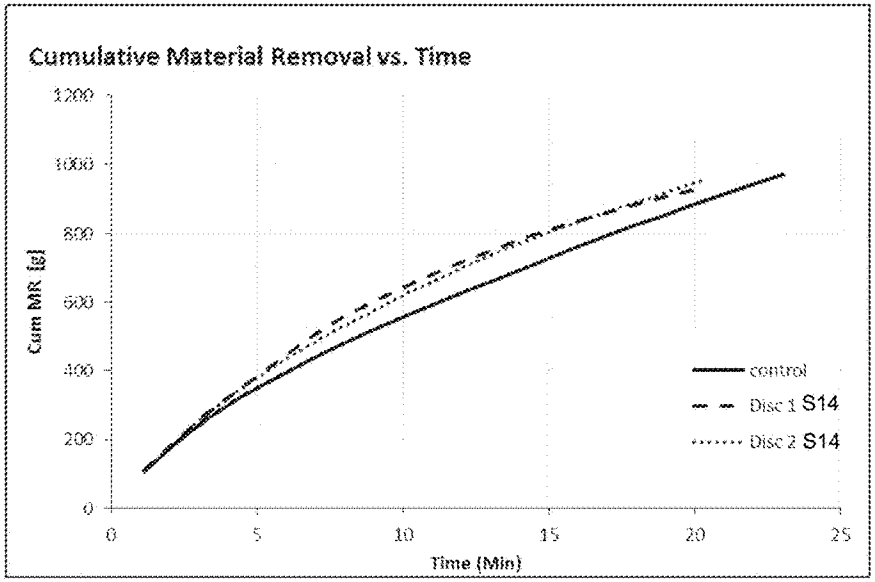
FIG. 14A is a graph showing cumulative material removal versus time by inventive abrasive disc embodiments compared to conventional abrasive discs.

Inventive abrasive discs were successfully prepared that included supersize coats including tribological performance enhancing compositions according to the formulation S14 of Example 7. Abrasive performance testing of the inventive discs and conventional comparative discs was conducted on 1026 carbon steel workpieces. The comparative discs did not have a supersize coating and were used as a control sample. The construction of the abrasive discs and the abrasive performance results are shown in Table 9. Cumulative material removed over time was graphed and is shown in FIG. 14A. Specific grinding energy ("SGE") versus cumulative material removed was graphed and is shown in FIG. 14B. Results indicate some improved abrasive performance for S14 and a reduced SGE during the initial duration of the life of the disc.

TABLE 9

| Abrasive Performance S14 on 1026 Carbon Steel | | | |
|---|---|---|---|
| Sample | Make Coat | Size Coat | Supersize Coat |
| C2 | Control | Control | None |
| S14 | Control | Control | S14 |

Example 9

Aggregate—Make Coat

Tribological enhancing compositions comprising aggregates comprising a polymeric binder composition and potassium fluoroborate, cryolite, or a combination thereof were prepared according to the details shown in Table 10.

TABLE 10

| Tribological enhancing compositions comprising aggregates S15 and S16 | | |
|---|---|---|
| | S15 wt % | S16 wt % |
| Phenolic Resin | 3 | 9 |
| $KBF_4$ | 97 | — |
| Cryolite | — | 91 |
| Total | 100.0 | 100.0 |

Example 10

Abrasive Performance Testing S15—1026 Carbon Steel

Figure 15A:
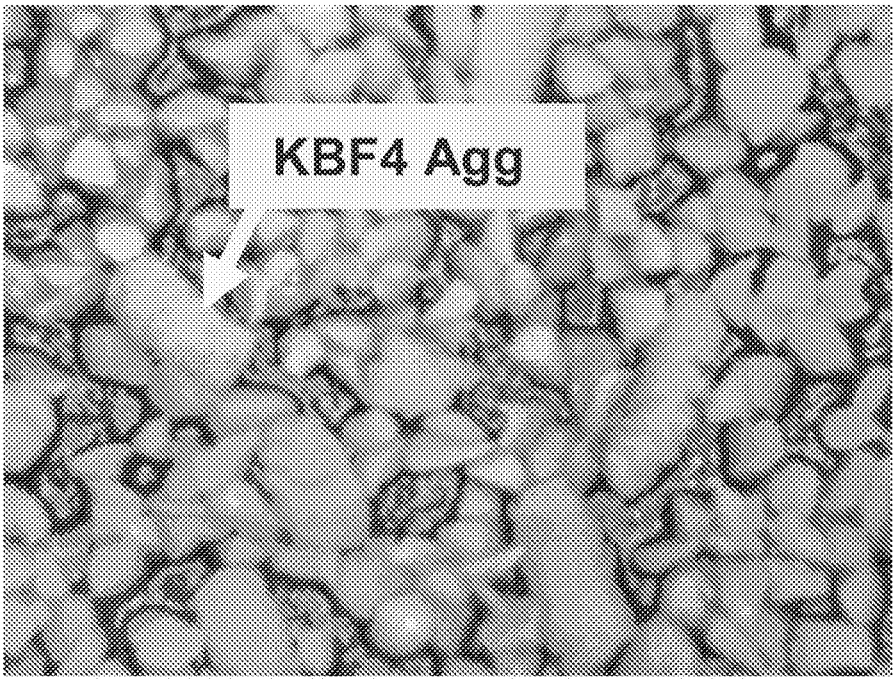
FIG. 15A is an image of an embodiment of a tribological performance enhancing composition aggregate disposed on a make coat along with abrasive grains prior to deposition of a size coat.
Figure 15B:
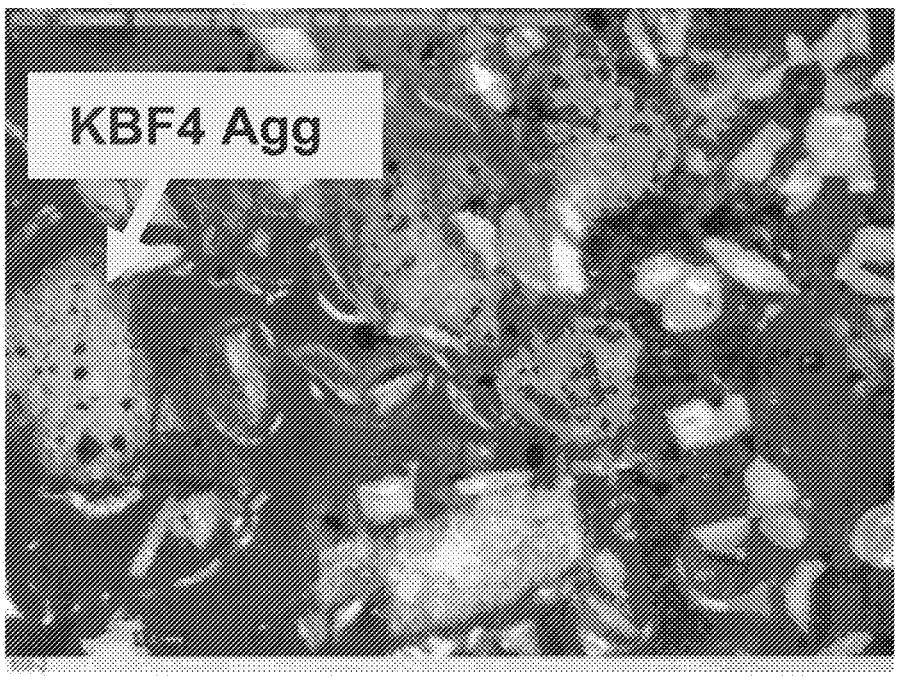
FIG. 15B is an image of the abrasive surface of the embodiment of 15A after a size coat has been applied and cured.
Figure 16A:
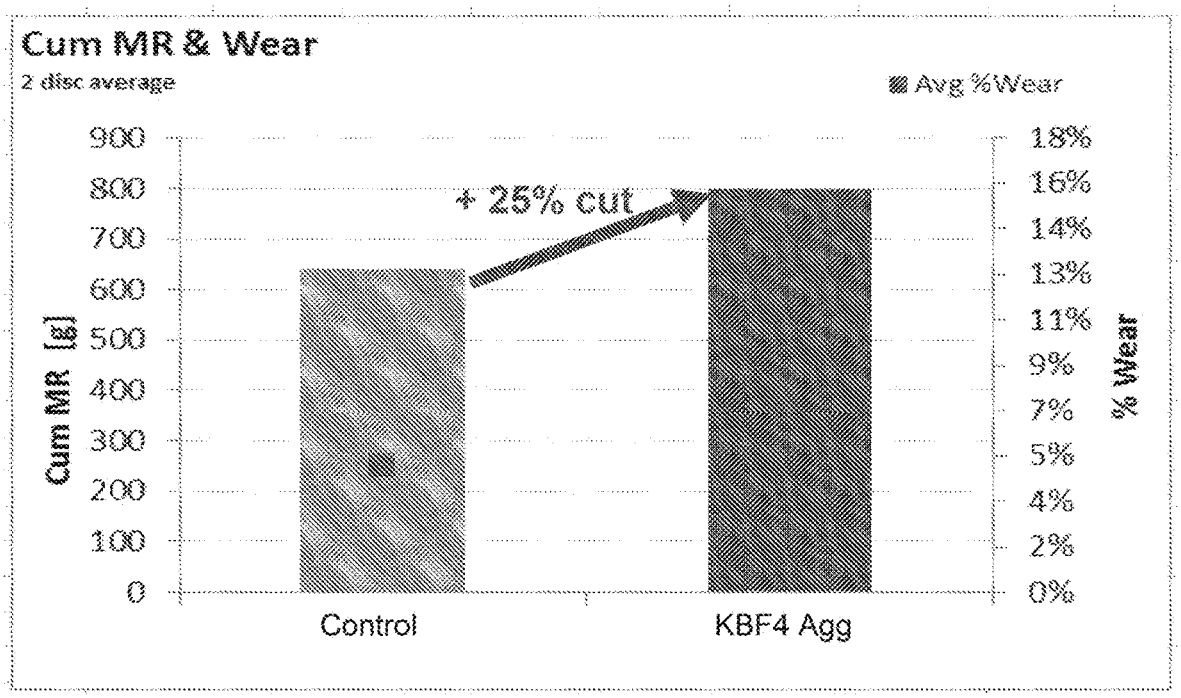
FIG. 16A is a bar graph showing cumulative material removal by inventive abrasive disc embodiments compared to conventional abrasive discs.
Figure 16B:
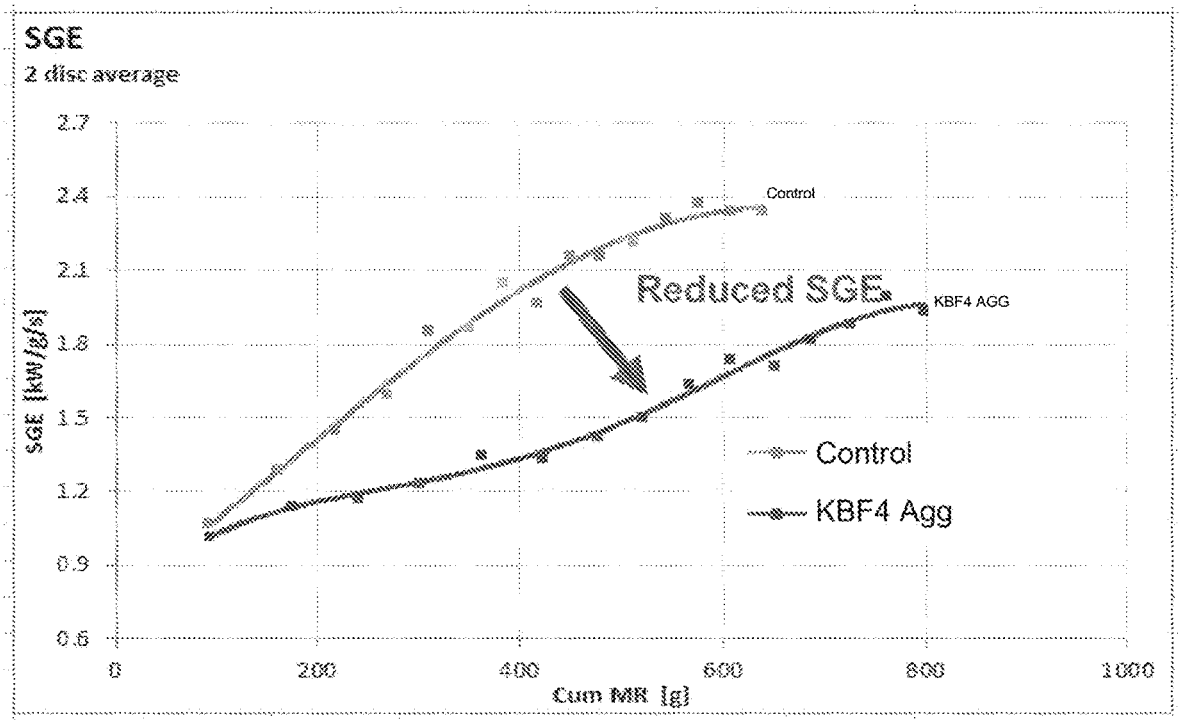
FIG. 16B is a graph showing specific grinding energy ("SGE") versus cumulative material removal by inventive abrasive disc embodiments compared to conventional abrasive discs.

Inventive abrasive discs were successfully prepared that included grinding aid aggregates having compositions according to formulation S15 of Example 9 that were disposed on the make coat along with the abrasive grains. FIG. 15A depicts the surface of the inventive abrasive disc of Example 10 prior to deposition of a size coat. FIG. 15B depicts the surface of the inventive abrasive disc of Example 10 after a size coat has been applied and cured. Abrasive performance testing of the inventive discs and conventional comparative discs was conducted on 1026 carbon steel workpieces. The comparative discs did not have any grinding aid aggregates in the make coat or any supersize coating and were used as a control sample. The construction of the abrasive discs and the abrasive performance results are shown in Table 11. Cumulative material removed and wear on the discs was graphed and is shown in FIG. 16A. Specific grinding energy ("SGE") versus cumulative material removed was graphed and is shown in FIG. 16B. Results indicate improved abrasive performance for S15 and a reduced SGE compared to the control.

TABLE 11

| Abrasive Performance S15 on 1026 Carbon Steel | | | | | |
|---|---|---|---|---|---|
| Sample | Make Coat | Size Coat | Supersize Coat | Avg. Cum. Cut Carbon Steel (As a % of C3) | Specific Grinding Energy (Compared to Control) |
| C3 | Control | Control | None | 100% | N/A |
| S15 | Control; S15 aggregates disposed on make coat | Control | None | 125% | Less than Control |

Example 11

Abrasive Performance Testing S15 and S16—1026 Carbon Steel

Figure 17:
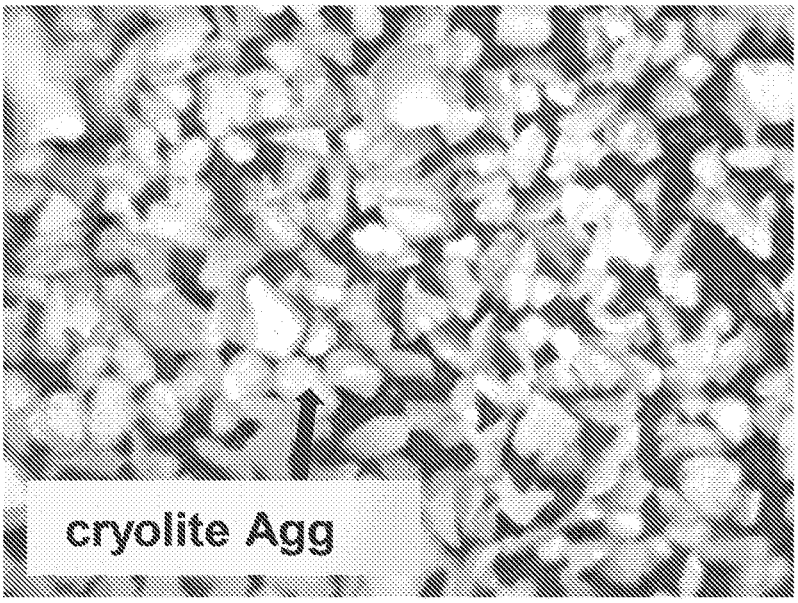
FIG. 17 is an image of an embodiment of a grinding aid aggregate disposed on a make coat along with abrasive grains prior to deposition of a size coat.
Figure 18A:
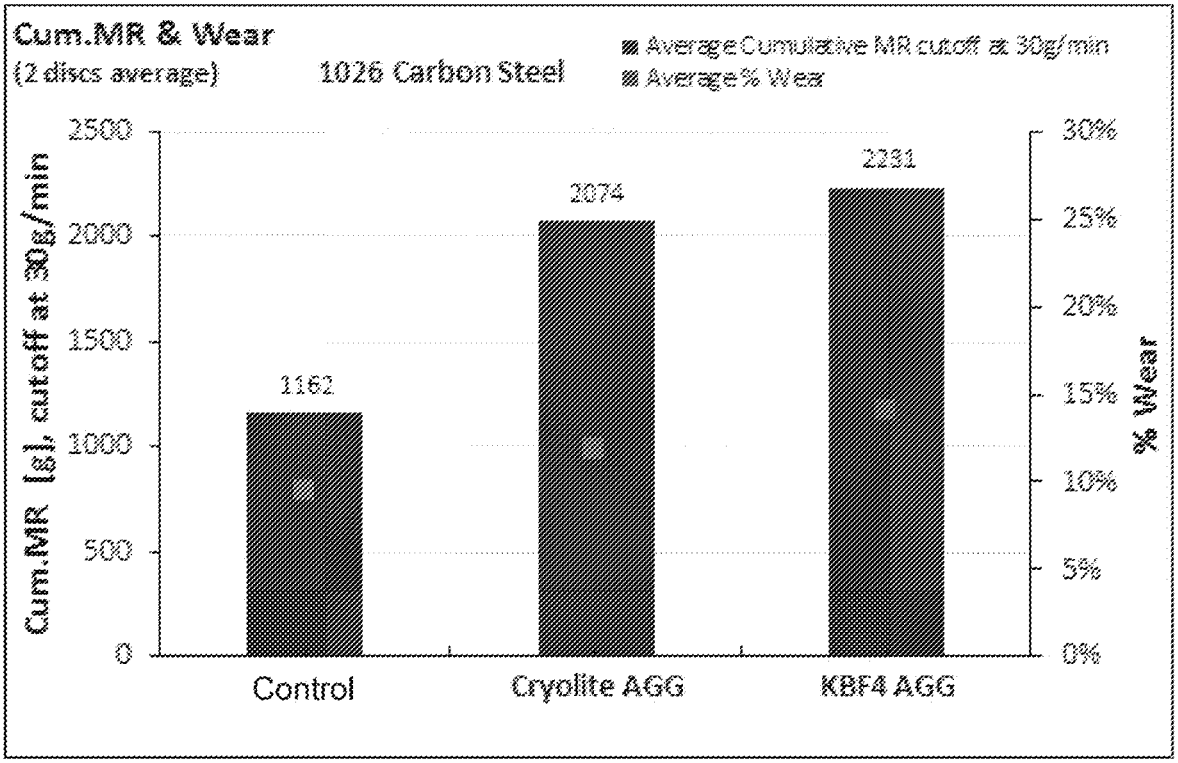
FIG. 18A is a bar graph showing cumulative material removal by inventive abrasive disc embodiments compared to conventional abrasive discs.
Figure 18B:
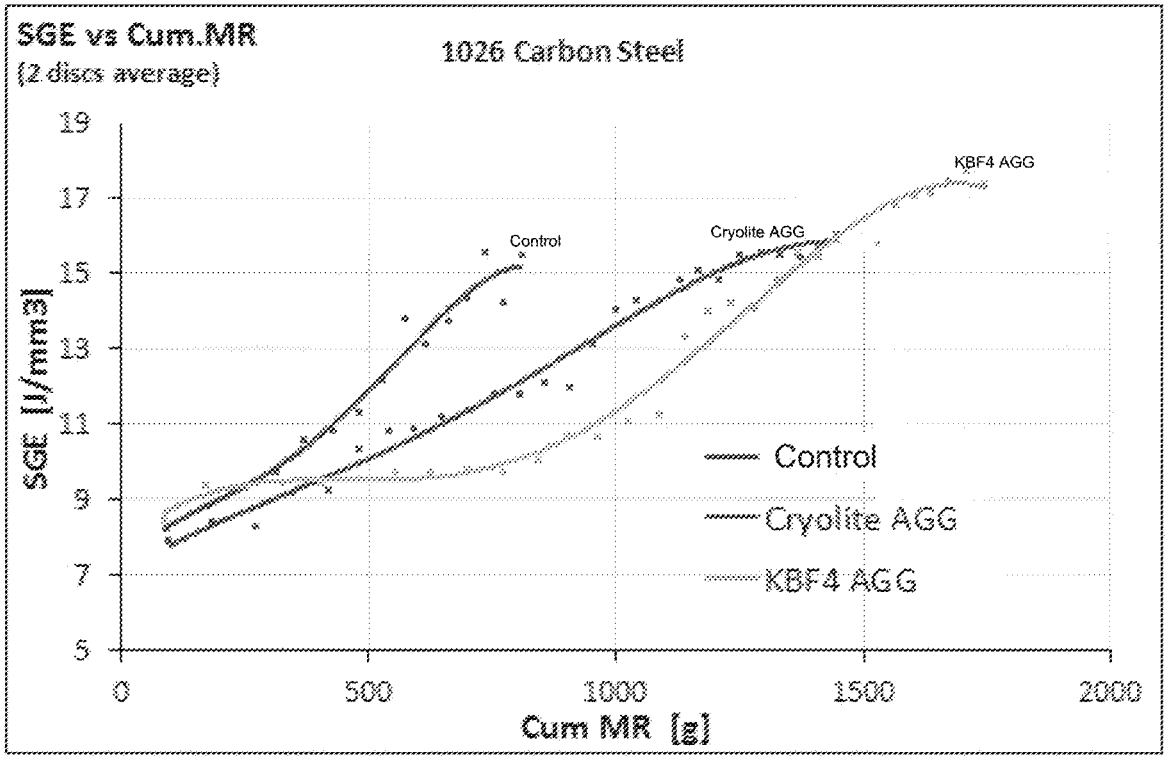
FIG. 18B is a graph showing specific grinding energy ("SGE") versus cumulative material removal by inventive abrasive disc embodiments compared to conventional abrasive discs.

Inventive abrasive discs were successfully prepared that included grinding aid aggregates having compositions according to formulation S15 and S16 of Example 9 that were disposed on the make coat along with the abrasive grains. FIG. 17 depicts the surface of the inventive abrasive disc S16 of Example 11 prior to deposition of a size coat Abrasive performance testing of the inventive discs and conventional comparative discs was conducted on 1026 carbon steel workpieces. The comparative discs did not have any grinding aid aggregates in the make coat or any supersize coating and were used as a control sample. The construction of the abrasive discs and the abrasive performance results are shown in Table 12. Cumulative material removed and wear on the discs was graphed and is shown in FIG. 18A. Specific grinding energy ("SGE") versus cumulative material removed was graphed and is shown in FIG. 18B. Results indicate improved abrasive performance for both S15 and S16 as well as reduced SGE compared to the control.

TABLE 12

| Abrasive Performance S15 on 1026 Carbon Steel | | | | | |
|---|---|---|---|---|---|
| Sample | Make Coat | Size Coat | Supersize Coat | Avg. Cum. Cut Carbon Steel (As a % of C3) | Specific Grinding Energy (Compared to Control) |
| C3 | Control | Control | None | 100% | N/A |
| S15 | Control; S15 aggregates disposed on make coat | Control | None | 178% | Less than Control |
| S16 | Control; S16 aggregates disposed on make coat | Control | None | 192% | Less than Control |

Example 12

Abrasive Performance Testing S15—IS 2062 Steel

Figure 19:
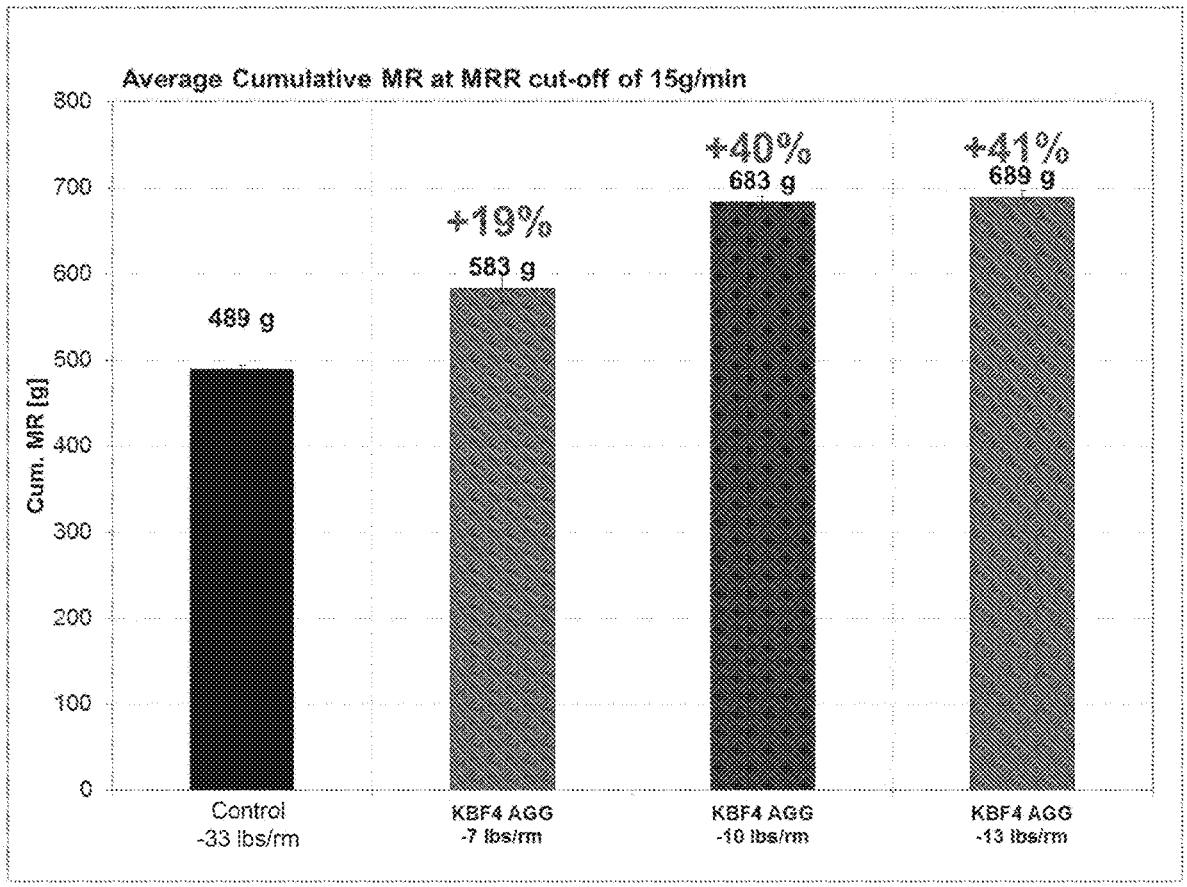
FIG. 19 is a bar graph showing cumulative material removal by inventive abrasive disc embodiments compared to conventional abrasive discs.

Inventive abrasive discs were successfully prepared that included grinding aid aggregates having compositions according to formulation S15 of Example 9 that were disposed on the make coat along with the abrasive grains. The loading weight (areal density) of the grinding aid aggregates was varied for samples D1-D3. Abrasive performance testing of the inventive discs and conventional comparative discs was conducted on IS 2062 Steel workpieces. The comparative discs did not have any grinding aid aggregates in the make coat or any supersize coating and were used as a control sample. The construction of the abrasive discs and the abrasive performance results are shown in Table 13. Cumulative material removed was graphed and is shown in FIG. 19. Results indicate improved abrasive performance for discs including the S15 grinding aid aggregates, but unexpectedly and surprisingly, the performance improvement, although significant, was not linear compared to the amount of S15 grinding aid aggregates loaded onto the make coat.

TABLE 13

| Abrasive Performance S15 on 1026 Carbon Steel | | | | | |
|---|---|---|---|---|---|
| Sample | Make Coat | Size Coat | Supersize Coat | Aggregate Add On weight (lbs/ream) | Avg. Cum. Cut Carbon Steel (As a % of C3) |
| C3 | Control | Control | None | — | 100% |
| D1 | Control; S15 aggregates disposed on make coat | Control | None | 7 | 119% |
| D2 | Control; S15 aggregates disposed on make coat | Control | None | 10 | 140% |
| D3 | Control; S15 aggregates disposed on make coat | Control | None | 13 | 141% |

Example 13

Abrasive Performance Testing S15-Belts

Inventive abrasive belts were successfully prepared that included grinding aid aggregates having compositions according to formulation S15 of Example 9 that were disposed on the make coat along with the abrasive grains. The wt % of the grinding aid aggregates was varied for samples D4-D5. Abrasive performance testing of the inventive belts and conventional comparative belts was conducted on INCONEL® alloy 718 workpieces. The comparative belts did not have any grinding aid aggregates in the make coat or any supersize coating and were used as a control sample. The construction of the abrasive belts and the abrasive performance results are shown in Table 14. Cumulative material removed was recorded. Results indicate improved abrasive performance for both D4 and D5 compared to the control. Results indicate improved abrasive performance for belts including the S15 grinding aid aggregates, but unexpectedly and surprisingly, the performance improvement, although significant, was not linear compared to the weight % of S15 grinding aid aggregates loaded onto the make coat.

TABLE 14

| Abrasive Performance S15 on 1026 Carbon Steel | | | | | |
|---|---|---|---|---|---|
| Sample | Make Coat | Size Coat | Supersize Coat | Aggregates (wt % of total grain weight) | Avg. Cum. Cut Carbon Steel (As a % of C4) |
| C4 | Control | Control | None | — | 100% |
| D4 | Control; S15 aggregates disposed on make coat | Control | None | 10 wt % | 183% |
| D5 | Control; S15 aggregates disposed on make coat | Control | None | 20 wt % | 180% |

Example 14

Preparation of Anti-Wear Composition

An anti-wear composition was prepared according to the formulation listed in Table 15.

TABLE 15

| Anti-Wear Composition | | |
|---|---|---|
| | Wt % Wet | Wt % Dry/Cured |
| Vycar 1022 | 60.7 | 52.8 |
| Lubrizol 1395 | 30.4 | 45.6 |
| Dynol 604 | 0.5 | 0.8 |
| Deefo 215 | 0.5 | 0.8 |
| Water | 7.9 | 0 |
| Total | 100.0 | 100.0 |

Components Listing

Vycar 1022—cellulose stabilized vinyl acetate homopolymer (available from Lubrizol Advanced Materials, Inc., Brecksville, OH).

Lubrizol® 1395—85% alkyl zinc dithiophosphate in mineral oil (available from Lubrizol Advanced Materials, Inc., Brecksville, OH)

Dynol 604—surfactant (available from Evonik Corporation, Allentown, PA)

Deefo 215—defoamer (available from Munzing Chemie, Abstatt, Germany)

Rhenocure® ZDT/S zinc dialkyl dithiophosphate 70% bound to silica particle 30% (available from RheinChemie Additives, Cologne, Germany)

MEGATRAN 240—Acrylic co-polymer (Styrene/Acrylates/Ammonium Methacrylate Copolymer Zinc Complex) commercially available from Interpolymer, Canton, MA Firebrake 415—Zinc Borate (available from Rio Tinto Borates, Greenwood Village, CO Zinc Stearate—generally commercially available The components were thoroughly mixed together to form an anti-wear composition.

Example 15

Abrasive Aggregates

Vitrified abrasive aggregates of aluminum oxide grit particles dispersed in a glass bond were soaked in the anti-wear composition so that the anti-wear composition was disposed within the aggregates between the grit particles of the aggregate and in the pores of the aggregate. Portions of the surface of the aggregates, and in some cases, the entire aggregate surface, were covered with the anti-wear composition. The aluminum oxide grit particles had an average size of P36 (~525-545 microns) while the aggregates had an average size from screen 10 to screen 18 (1 mm to 2 mm). The treated aggregates were collected and dried in an oven until the anti-wear composition was solidified ("cured").

Example 16

Coated Abrasive Preparation with Abrasive Aggregates

A sample coated abrasive will be prepared that includes the treated abrasive aggregates of Example 15. The sample coated abrasive will be tested to determine its abrasive performance compared to a control sample. Beneficial abrasive results for the sample coated abrasive will be observed.

Example 17

Supersize Coat: Anti-Wear and Sulfide Scavenging Composition: Zinc Borate

A supersize coat was prepared that included an anti-wear composition and a sulfide scavenging composition according to the formulation listed in Table 16.

TABLE 16

| Anti-Wear and Sulfide Scavenging Composition | | |
|---|---|---|
| | Wt % Wet | Wt % Dry/Cured |
| Vycar 1022 | 52.1 | 48.3 |
| Rhenocure ZDT/S | 15.7 | 25.1 |
| Firebrake 415 | 15.6 | 25.1 |
| Dynol 604 | 0.5 | 0.8 |

TABLE 16-continued

| Anti-Wear and Sulfide Scavenging Composition | | |
|---|---|---|
| | Wt % Wet | Wt % Dry/Cured |
| Deefo 215 | 0.5 | 0.8 |
| Water | 15.6 | 0 |
| Total | 100.0 | 100.0 |

Figure 20A:
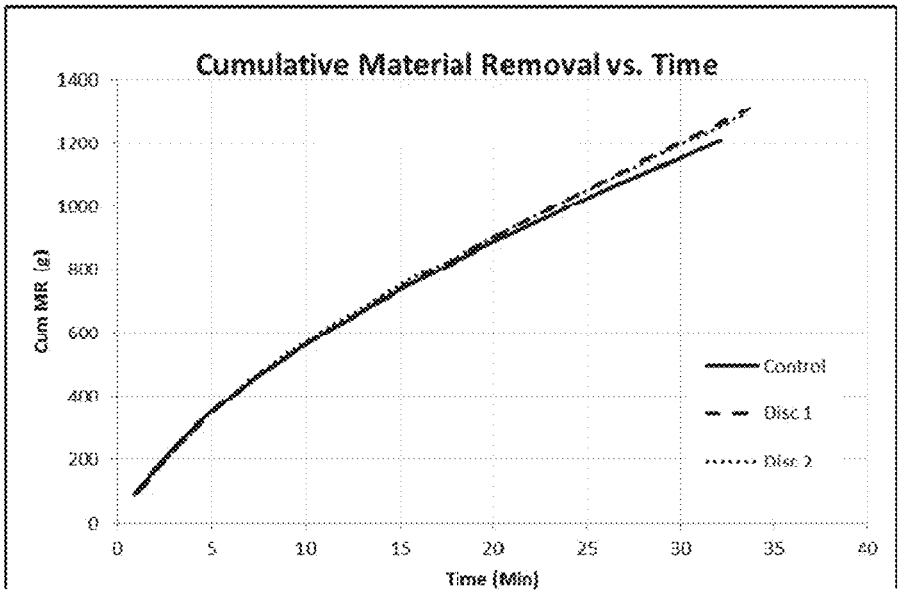
FIG. 20A is a graph of abrasive performance data (Cumulative Material Removal vs. Time) comparing inventive sample discs to control discs.
Figure 20B:
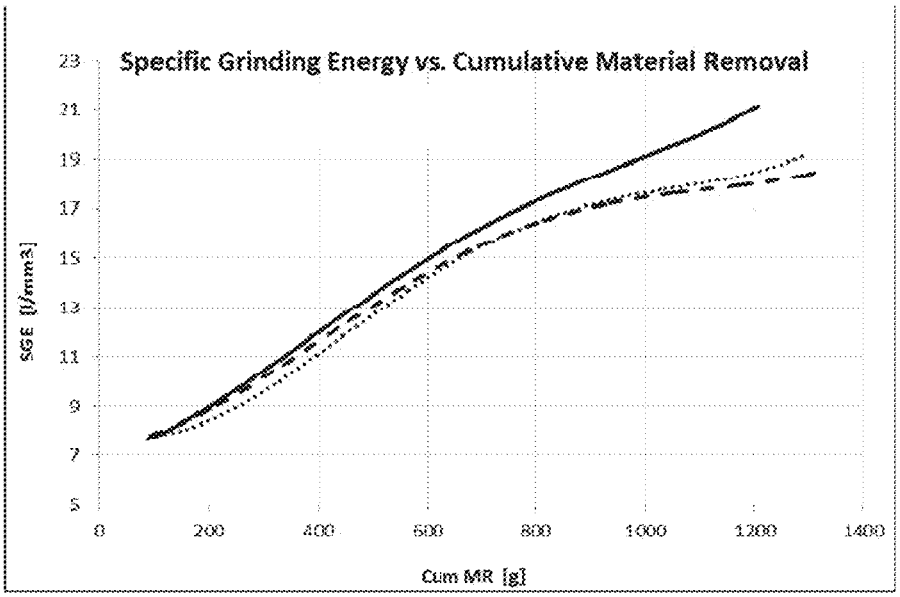
FIG. 20B is a graph of abrasive performance data (Specific Grinding Energy vs. Cumulative Material Removal) comparing inventive sample discs to control discs.

The supersize coating was applied to abrasive discs to form inventive samples. Abrasive testing was conducted comparing the sample discs to a comparative abrasive disc where the only difference was that the comparative disc did not have any supersize coat. The results of the abrasive testing are summarized in Table 17 and shown in FIG. 20A and FIG. 20B.

TABLE 17

| Abrasive Performance Summary | |
|---|---|
| Performance Testing: | 1026 carbon steel workpiece |
| Cumulative Material Removal [grams]: | Inventive sample produced avg. of 106% cumulative cut compared to the uncoated control. Increased cut achieved. |
| Specific Grinding Energy (SGE) [J/mm3]: | The inventive sample consumed avg. of 86-90% of the specific grinding energy compared to the uncoated control. Reduced SGE achieved. |

Example 18

Supersize Coat—Anti-Wear and Sulfide Scavenging Composition: Zinc Stearate

A supersize coat was prepared that included an anti-wear composition and a sulfide scavenging composition according to the formulation listed in Table 18.

TABLE 18

| Anti-Wear and Sulfide Scavenging Composition | | |
|---|---|---|
| | Wt % Wet | Wt % Dry/Cured |
| Vycar 1022 | 51.4 | 38.0 |
| Rhenocure ZDT/S | 15.4 | 19.8 |
| Zinc Stearate | 32.2 | 41.0 |
| Dynol 604 | 0.5 | 0.6 |
| Deefo 215 | 0.5 | 0.6 |
| Water | 0 | 0 |
| Total | 100.0 | 100.0 |

Figure 21A:
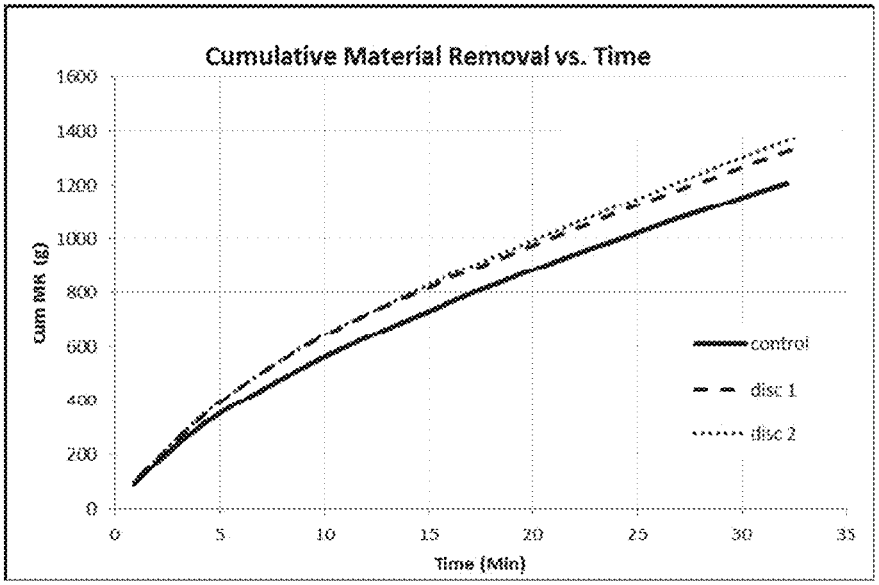
FIG. 21A is a graph of abrasive performance data (Cumulative Material Removal vs. Time) comparing inventive sample discs to control discs.
Figure 21B:
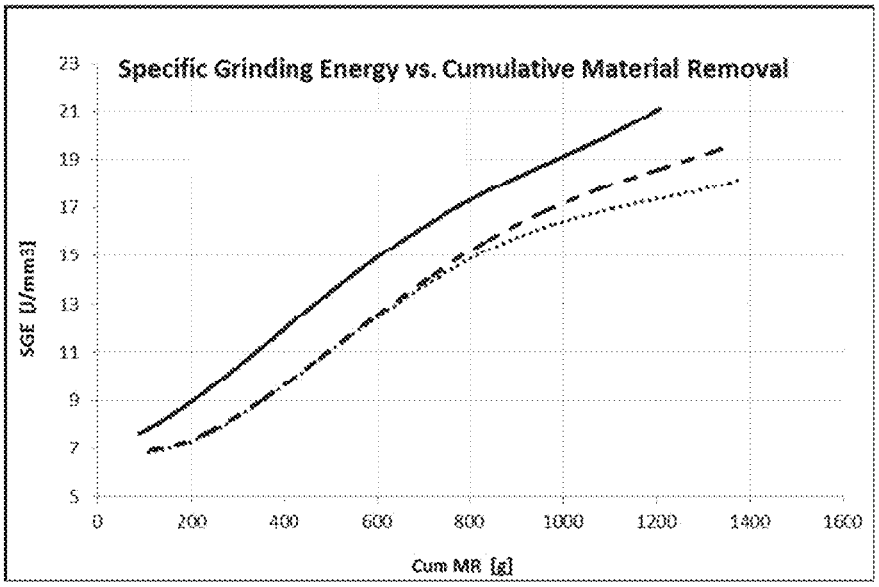
FIG. 21B is a graph of abrasive performance data (Specific Grinding Energy vs. Cumulative Material Removal) comparing inventive sample discs to control discs.

The supersize coating was applied to abrasive discs to form inventive samples. Abrasive testing was conducted comparing the sample discs to a comparative abrasive disc where the only difference was that the comparative disc did not have any supersize coat. The results of the abrasive testing are summarized in Table 19 and shown in FIG. 21A and FIG. 21B.

TABLE 19

| Abrasive Performance Summary | |
|---|---|
| Performance Testing: | 1026 carbon steel workpiece |
| Cumulative Material Removal [grams]: | Inventive samples produced avg. of 111-113% cumulative cut compared to the uncoated control. Increased cut achieved. |

TABLE 19-continued

| Abrasive Performance Summary | |
|---|---|
| Specific Grinding Energy (SGE) [J/mm3]: | The inventive samples consumed avg. of 86-91% of the specific grinding energy compared to the uncoated control. Reduced SGE achieved. |

Example 19

Supersize Coat—Anti-Wear and Zinc Cross-Linked Acrylic Composition

A supersize coat was prepared that included an anti-wear composition and a zinc cross-linked acrylic composition according to the formulation listed in Table 20.

TABLE 20

| Anti-Wear and Zinc Cross-Linked Acrylic Composition | | |
|---|---|---|
| | Wt % Wet | Wt % Dry/Cured |
| Megatran 240 | 70.9 | 48.1 |
| Rhenocure ZDT/S | 28.1 | 50.1 |
| Dynol 604 | 0.5 | 0.9 |
| Deefo 215 | 0.5 | 0.9 |
| Water | 0 | 0 |
| Total | 100.0 | 100.0 |

Figure 22A:
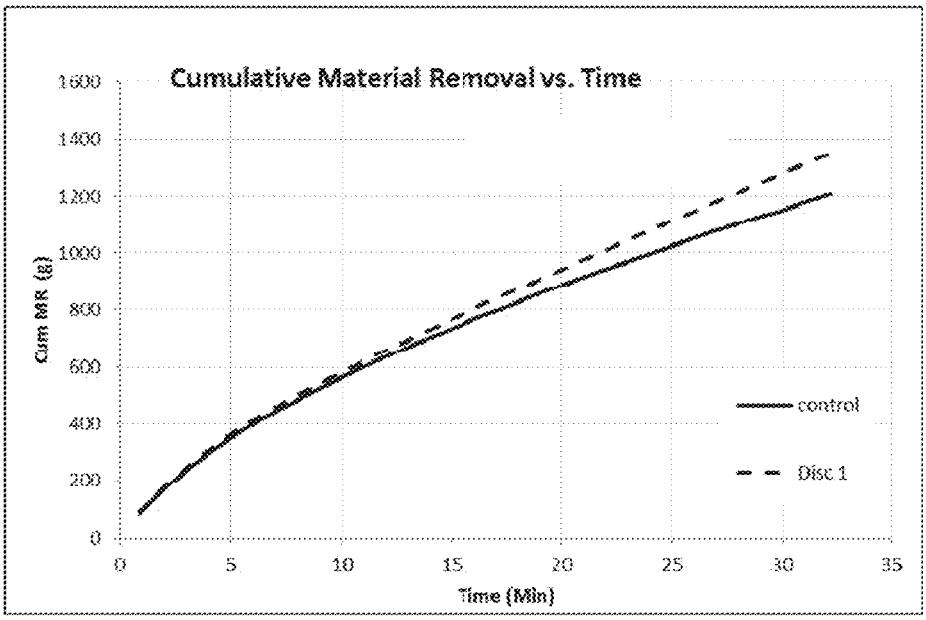
FIG. 22A is a graph of abrasive performance data (Cumulative Material Removal vs. Time) comparing an inventive sample disc to a control disc.
Figure 22B:
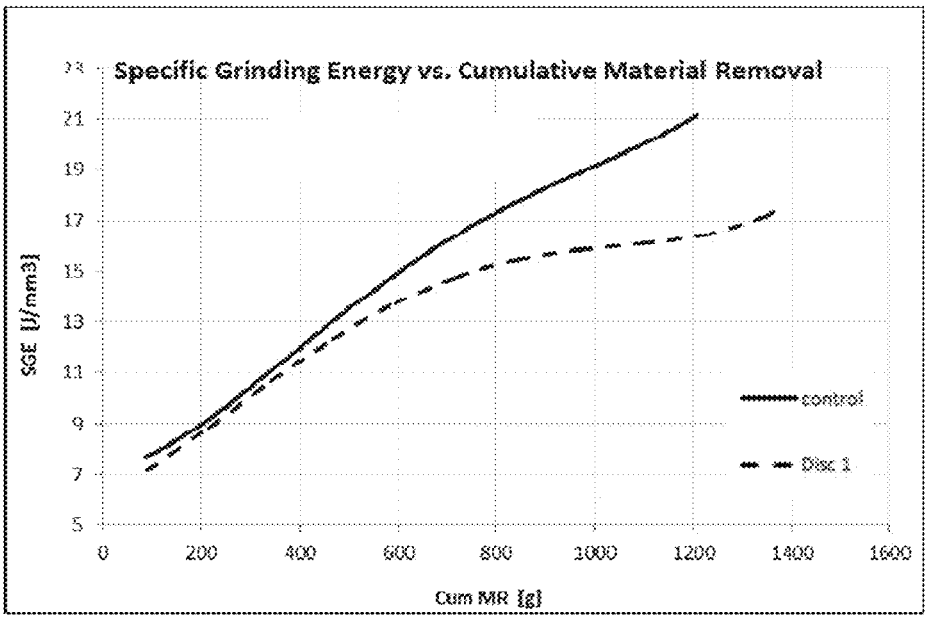
FIG. 22B is a graph of abrasive performance data (Specific Grinding Energy vs. Cumulative Material Removal) comparing an inventive sample disc to a control disc.

The supersize coating was applied to an abrasive disc to form an inventive sample. Abrasive testing was conducted comparing the sample disc to a comparative abrasive disc where the only difference was that the comparative disc did not have any supersize coat. The results of the abrasive testing are summarized in Table 21 and shown in FIG. 22A and FIG. 22B.

TABLE 21

| Abrasive Performance Summary | |
|---|---|
| Performance Testing: | 1026 carbon steel workpiece |
| Cumulative Material Removal [grams]: | Inventive sample produced 113% of the cumulative cut compared to the uncoated control. Increased cut achieved. |
| Specific Grinding Energy (SGE) [J/mm3]: | The inventive samples consumed 81% of the specific grinding energy compared to the uncoated control. Reduced SGE achieved. |

In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Moreover, not all of the activities described above in the general description or the examples are required, that a portion of a specific activity can not be required, and that one or more further activities can be performed in addition to those described. Still further, the order in which activities are listed is not necessarily the order in which they are performed.

The disclosure is submitted with the understanding that it will not be used to limit the scope or meaning of the claims. In addition, in the foregoing disclosure, certain features that are, for clarity, described herein in the context of separate embodiments, can also be provided in combination in a single embodiment. Conversely, various features that are, for brevity, described in the context of a single embodiment, can also be provided separately or in any subcombination. Still, inventive subject matter can be directed to less than all features of any of the disclosed embodiments.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, or essential feature of any or all the claims.

Thus, to the maximum extent allowed by law, the scope of the present invention is to be determined by the broadest permissible interpretation of the following claims and their equivalents, and shall not be restricted or limited by the foregoing detailed description.

What is claimed is:

1. An abrasive article, comprising:

a substrate;

an abrasive layer disposed on the substrate, wherein the abrasive layer comprises a plurality of aggregates, and wherein each of the plurality of aggregates comprises an aggregate binder composition, a plurality abrasive particles, and a grinding aid composition comprising potassium fluoroborate, wherein each of the plurality of aggregates comprise 60 to 99 wt. % of potassium fluoroborate.

2. The abrasive article of claim 1, comprising a ratio of average aggregate size to average abrasive grain size in a range of 1:10 to 10:1.

3. The abrasive article of claim 1, wherein each of the plurality of aggregates comprise 0.5 to 60 wt. % of the aggregate binder composition.

4. The abrasive article of claim 1, wherein each of the plurality of aggregates comprise 80 wt. % of the abrasive particles.

5. An abrasive article, comprising:

a substrate;

an abrasive layer disposed on the substrate, wherein the abrasive layer comprises a plurality of aggregates, and wherein each of the plurality of aggregates comprises an aggregate binder composition, a plurality abrasive particles, and a grinding aid composition comprising potassium fluoroborate, wherein each of the plurality of aggregates comprise:

30 to 95 wt. % of the potassium fluoroborate;

0.5 to 35 wt. % of the aggregate binder composition; and 5 to 35 wt. % of the abrasive particles.

6. The abrasive article of claim 1, wherein the aggregate binder composition comprises a ceramic binder, a vitreous binder, a polymeric resin binder, or a combination thereof.

7. The abrasive article of claim 6, wherein the aggregate binder composition comprises a vitreous binder.

8. The abrasive article of claim 6, wherein the polymeric resin binder comprises a phenolic polymeric composition.

9. The abrasive article of claim 8, wherein the phenolic polymeric compositions comprises a phenolic resole composition, a urea formaldehyde composition, a urethane composition, an epoxy composition, a polyimide composition, a polyamide composition, a polyester composition, an acrylate composition, a protein based composition, a starch based composition, or any combination thereof.

10. The abrasive article of claim 1, wherein the aggregate binder composition comprises a continuous phase in each of the plurality of aggregates.

11. The abrasive article of claim 1, wherein the aggregate binder composition comprises a discontinuous phase in each of the plurality of aggregates.

12. The abrasive article of claim 11, wherein the aggregate binder composition comprises bond posts at points of contact between abrasive particles.

13. The abrasive article of claim 1, wherein the abrasive particles comprise silica, alumina, zirconia, silicon carbide, silicon nitride, boron nitride, garnet, diamond, co-fused alumina zirconia, ceria, titanium diboride, boron carbide, flint, emery, alumina nitride, or a combination thereof.

14. The abrasive article of claim 1, wherein each of the plurality of aggregates are in a range of at least 20 microns to not greater than 4000 microns.

15. The abrasive article of claim 1, wherein the abrasive layer comprises a make coat, a size coat, a supersize coat, or a combination thereof.

16. The abrasive article of claim 15, wherein the plurality of aggregates are disposed in the make coat, the size coat, or a combination thereof.

17. A method of forming an abrasive article, comprising: providing a substrate; and disposing an abrasive layer disposed on the substrate, wherein the abrasive layer comprises a plurality of aggregates, and wherein each of the plurality of aggregates comprises an aggregate binder composition, a plurality abrasive particles, and a grinding aid composition comprising potassium fluoroborate, wherein each of the plurality of aggregates comprise 60 to 99 wt. % of potassium fluoroborate.

18. The abrasive article of claim 17, wherein each of the plurality of aggregates comprise 0.5 to 60 wt. % of the aggregate binder composition.

19. The abrasive article of claim 17, wherein each of the plurality of aggregates comprise 5 to 80 wt. % of the abrasive particles.

20. The abrasive article of claim 16, wherein the plurality of aggregates are disposed in the make coat.

21. The abrasive article of claim 16, wherein the plurality of aggregates are disposed on or in the size coat.

22. The abrasive article of claim 1, wherein each aggregate comprises 0.5 to 35 wt. % of the aggregate binder composition.

23. The abrasive article of claim 1, wherein each aggregate comprises 5 to 35 wt. % of the abrasive particles.

24. The abrasive article of claim 1, wherein the abrasive particles comprise alumina.

25. The abrasive article of claim 8, wherein each of the plurality of aggregates comprises not greater than 60 wt. % of the aggregate binder composition.

26. The abrasive article of claim 10, wherein each of the plurality of aggregates comprises:

0.5 to 35 wt. % of the aggregate binder composition; and 5 to 35 wt. % of the abrasive particles.

27. The abrasive article of claim 11, wherein each of the plurality of aggregates comprises:

0.5 to 35 wt. % of the aggregate binder composition; and to 35 wt. % of the abrasive particles.

28. The abrasive article of claim 1, further comprising a second plurality of abrasive particles disposed on or in the make coat, and wherein the plurality of aggregates are distinct from the abrasive particles.

29. The abrasive article of claim 28, wherein the second plurality of abrasive particles includes shaped abrasive particles.

30. The abrasive article of claim 28, wherein the second plurality of abrasive particles comprise alpha alumina.

31. The abrasive article of claim 28, wherein the second plurality of abrasive particles are in a size coat overlying the make coat.

32. The abrasive article of claim 30, wherein at least a portion of the second plurality of abrasive particles are oriented to have a tip pointing away from the substrate.

33. The abrasive article of claim 30, wherein each of the particle of the second plurality of abrasive particles are shaped abrasive particles.

34. The abrasive article of claim 29, wherein the second plurality of abrasive particles includes randomly shaped abrasive particles.

35. The abrasive article of claim 29, wherein the second plurality of abrasive particles and the plurality of aggregates are disposed on or in the make coat.

36. The abrasive article of claim 1, wherein each of the plurality of aggregates are in a range of at least 50 microns to not greater than 2000 microns.

37. The abrasive article of claim 15, wherein the abrasive article further comprises a supersize coat overlying the size coat.

38. The abrasive article of claim 37, wherein the supersize coat comprises an acetate composition; polyvinyl acetate; a phenolic polymeric composition; a phenolic resole composition; a urea formaldehyde composition; a melamine composition; a urethane composition; an epoxy composition; a polyimide composition; a polyamide composition; a polyester composition; an acrylate composition; a UV curable acrylate composition; a zinc cross-linked acrylic composition; a rubber composition; a styrene butadiene rubber; a protein based composition; a starch based composition, or a combination thereof.

39. The abrasive article of claim 1, wherein the backing comprises a polymeric film, a polyolefin film, a polyester film, a polyamide film, a cellulose ester film, a metal foil, a mesh, a foam, a cloth; a paper; a vulcanized paper; a vulcanized rubber; a vulcanized fiber; nonwoven materials; a combination thereof; or a treated version thereof.

40. The abrasive article of claim 5, wherein the aggregate binder comprises a phenolic resole composition, a urea formaldehyde composition, a urethane composition, an epoxy composition, a polyimide composition, a polyamide composition, a polyester composition, an acrylate composition, a protein based composition, a starch based composition, or any combination thereof.

41. The abrasive article of claim 5, wherein the aggregate binder composition comprises a continuous phase in each of the plurality of aggregates.

42. The abrasive article of claim 5, wherein the aggregate binder composition comprises a discontinuous phase in each of the plurality of aggregates.

43. The abrasive article of claim 5, further comprising a second plurality of abrasive particles disposed on or in the make coat, and wherein the plurality of aggregates are distinct from the abrasive particles.

44. The abrasive article of claim 43, wherein the second plurality of abrasive particles includes shaped abrasive particles.

45. The abrasive article of claim 44, wherein the second plurality of abrasive particles comprise alpha alumina.

46. The abrasive article of claim 44, wherein the second plurality of abrasive particles are in a size coat overlying the make coat.

47. The abrasive article of claim 44, wherein at least a portion of the second plurality of abrasive particles are oriented to have a tip pointing away from the substrate.

48. The abrasive article of claim 44, wherein each of the particle of the second plurality of abrasive particles are shaped abrasive particles.

49. The abrasive article of claim 43, wherein the second plurality of abrasive particles includes randomly shaped abrasive particles.

50. The abrasive article of claim 43, wherein the second plurality of abrasive particles and the plurality of aggregates are disposed on or in the make coat.

51. The abrasive article of claim 5, wherein the abrasive article further comprises a supersize coat overlying the size coat.

52. The abrasive article of claim 51, wherein the supersize coat comprises an acetate composition; polyvinyl acetate; a phenolic polymeric composition; phenolic resole composition; a urea formaldehyde composition; a melamine composition; a urethane composition; an epoxy composition; a polyimide composition; a polyamide composition; a polyester composition; an acrylate composition; a UV curable acrylate composition; a zinc cross-linked acrylic composition; a rubber composition; a styrene butadiene rubber; a protein based composition; a starch based composition, or a combination thereof.

* * * * *